US007490921B2

(12) United States Patent
Hashi et al.

(10) Patent No.: US 7,490,921 B2
(45) Date of Patent: Feb. 17, 2009

(54) MAINTENANCE APPARATUS OF RECORDING HEAD

(75) Inventors: Hiroshi Hashi, Tokyo (JP); Masanobu Shimizu, Hachioji (JP)

(73) Assignee: Olympus Corporation, Tokyo (JP)

( * ) Notice: Subject to any disclaimer, the term of this patent is extended or adjusted under 35 U.S.C. 154(b) by 453 days.

(21) Appl. No.: 11/318,401

(22) Filed: Dec. 22, 2005

(65) Prior Publication Data

US 2006/0139397 A1 Jun. 29, 2006

(30) Foreign Application Priority Data

Dec. 27, 2004 (JP) ..... 2004-377124
Feb. 7, 2005 (JP) ..... 2005-030645

(51) Int. Cl.
*B41J 2/165* (2006.01)

(52) U.S. Cl. ..... 347/29; 347/30; 347/32

(58) Field of Classification Search ..... 347/29, 347/30, 32, 33
See application file for complete search history.

(56) References Cited

U.S. PATENT DOCUMENTS 7,004,560 B2 * 2/2006 Yamada et al. ..... 347/30

FOREIGN PATENT DOCUMENTS

| | | |
|---|---|---|
| JP | 5-201028 A | 8/1993 |
| JP | 3065818 B2 | 5/2000 |
| JP | 3161050 B2 | 2/2001 |

* cited by examiner

*Primary Examiner*—Shih-wen Hsieh
(74) *Attorney, Agent, or Firm*—Frishauf, Holtz, Goodman & Chick, P.C.

(57) ABSTRACT

A maintenance apparatus of a recording head is appressed against a head main body of a recording head during cleaning processing, and an air current which performs suction and removal flows in a direction crossing an ink discharge direction and travels along a nozzle surface to suck foreign particles or a residual ink.

26 Claims, 20 Drawing Sheets

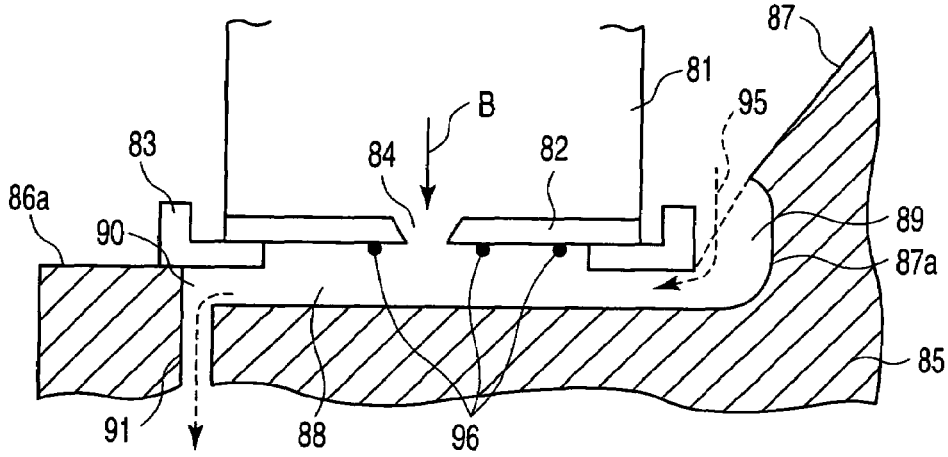
FIG. 24
FIG. 25
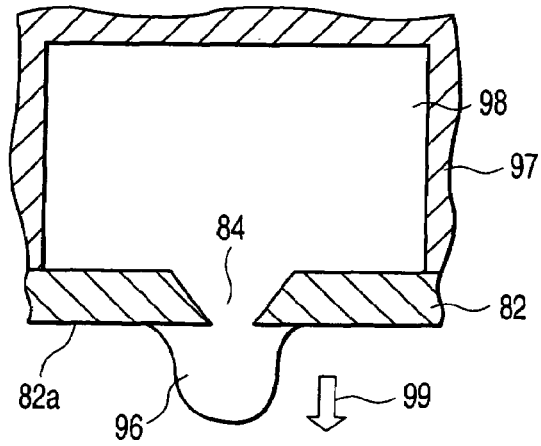
FIG. 26
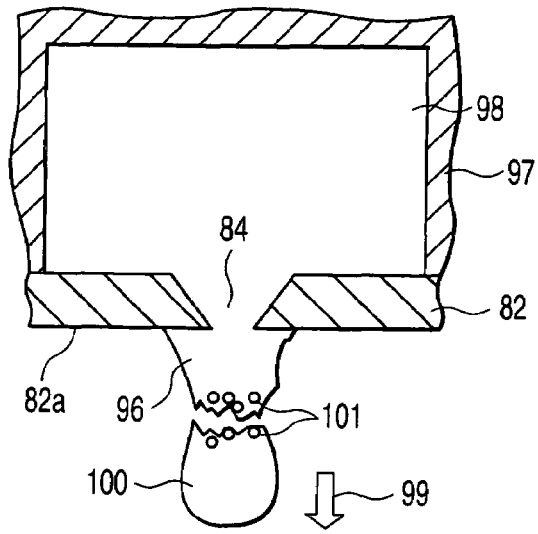

FIG. 38
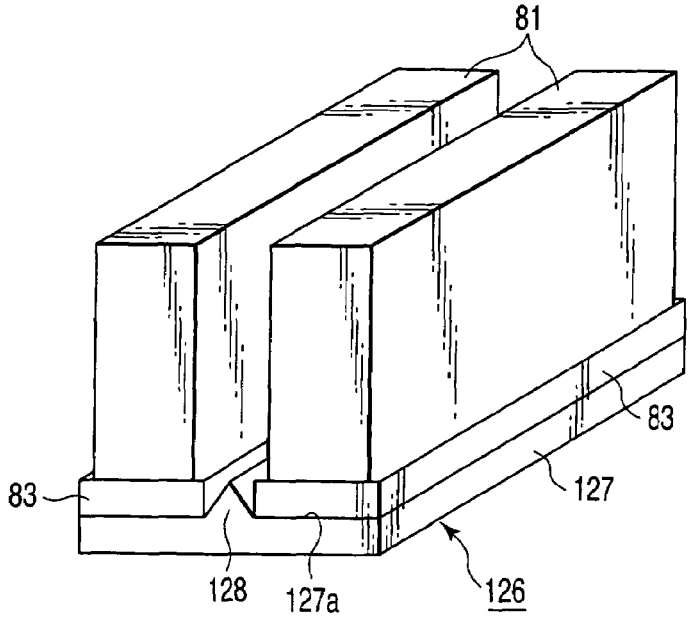
FIG. 39
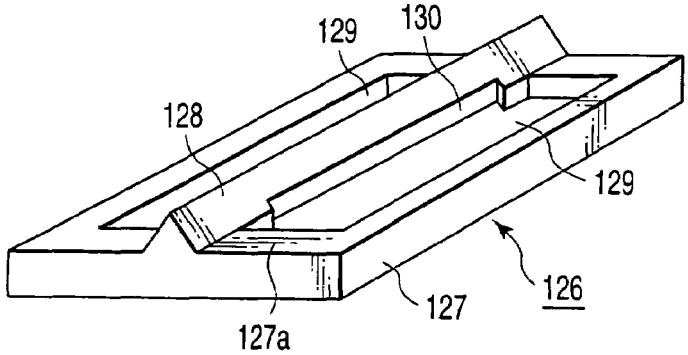
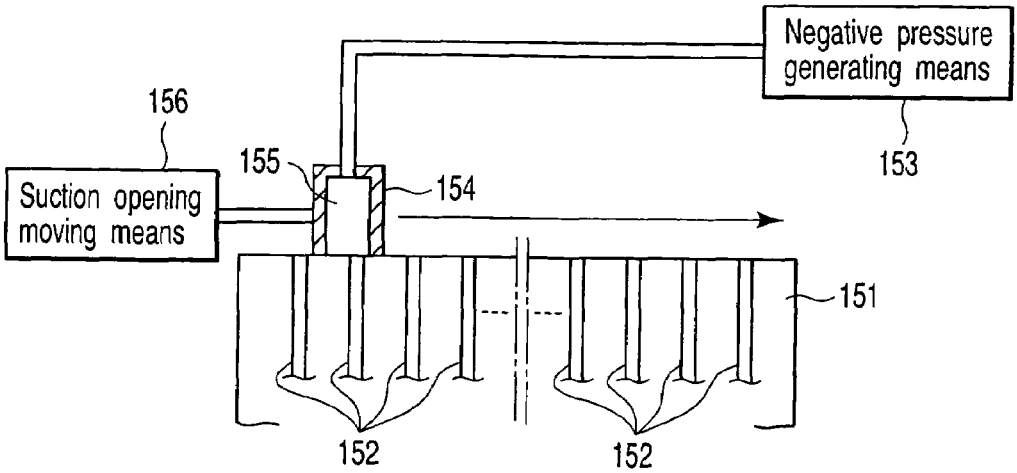
FIG. 40 PRIOR ART

MAINTENANCE APPARATUS OF RECORDING HEAD

CROSS-REFERENCE TO RELATED APPLICATIONS

This application is based upon and claims the benefit of priority from prior Japanese Patent Applications No. 2004-377124, filed Dec. 27, 2004; and No. 2005-030645, filed Feb. 7, 2005, the entire contents of both of which are incorporated herein by reference.

BACKGROUND OF THE INVENTION

1. Field of the Invention

The present invention relates to a maintenance apparatus of a recording head in an image recording apparatus which records an image in a recording medium.

2. Description of the Related Art

In general, as a printer, there is known one which has recording heads based on an inkjet scheme and discharges ink droplets to a paper sheet carried by paper feeding means from a plurality of nozzles of these recording heads, thereby recording an image having a high quality at a high speed.

Meanwhile, in such a printer, it is often the case that foreign particles such as paper particles of a recording paper sheet adhere to an ink discharge opening of an ink chamber constituting an inkjet recording head to provoke clogging or air bubbles enter the ink discharge opening to collapse surface tension of the ink, and discharge of the ink from the ink chamber becomes impossible or a discharge direction is deflected by these factors.

Therefore, it has been conventionally determined that a maintenance operation for rapidly recovering from such a situation is necessary. As this maintenance method, there is a method by which an entire nozzle plate on which nozzles are arranged is covered and all the nozzles are simultaneously sucked or some of the nozzles are sucked, thereby removing foreign particles or the ink which has adhered to the nozzles.

For example, as shown in FIG. 40, Jpn. Pat. Appln. No. H5-201028 discloses a maintenance apparatus for a recording head, which brings a sucking portion 154 having a suction opening 155 sucked by negative pressure generating means 153 consisting of a pump or the like to touch a surface on which nozzles 152 of a head main body 151 while moving the sucking portion 154 by suction opening moving means 156, thereby sucking and removing foreign particles or an ink which has adhered to all the nozzles 152

Further, in Japanese Patent No. 3161050discloses a maintenance apparatus of a recording head, which has a configuration in which a suction opening is brought to touch an ink jet recording head, and a suction pump is driven to suck an ink inside/outside nozzles and foreign particles or the like on a head main body end surface, thereby effecting maintenance processing. At this time, an air current becomes parallel with the head main body end surface around the suction opening so that ink droplets, an outflow of ink, foreign particles and others which have adhered to the head main body end surface are drawn and sucked into the suction opening. Furthermore, Japanese Patent No. 3065818 discloses a maintenance apparatus which moves a sucking portion of an ink suction unit along a surface of an orifice, cleans and collects ink droplets or foreign particles which have adhered to a surrounding part of the orifice, thus removing a factor of a discharge defect.

In the configuration disclosed in Jpn. Pat. Appln. No. H5-201028, an ink or the like is pulled out in a perpendicular direction which is the same as an ink squirting direction of nozzles by a suction force of a suction opening which is to touch a nozzle surface. Therefore, the ink breaks into small pieces in the vicinity of a nozzle end portion, and hence there is a problem that bubbles are apt to be generated. That is, when suction is performed from the suction opening in the perpendicular direction of the nozzle openings (i.e., the ink squirting direction), the ink in the nozzles broke off into small pieces. As a result, the ink or foreign particles in the nozzles can be sucked and removed, but air bubbles remain in the nozzles after execution of the maintenance, which can be a factor which avoids discharge of the ink or deflects an ink discharge path.

In the maintenance apparatus disclosed in Japanese Patent No. 3161050 mentioned above, when performing suction in the maintenance processing, an air stream (or air current) generated by a vacuum nozzle flows in a direction which cuts longitudinally a nozzle string (a direction along a direction of the nozzle string). In such suction, since the air stream passes and flows above many nozzles in such a manner that it cuts longitudinally the nozzle string, foreign particles such as dust or an ink remaining on an nozzle surface (dust included in this ink) which is moved by the air stream travels above other nozzles or passes through a nozzle surface along a long direction. When the air stream passes therethrough, the nozzles may be newly clogged, the nozzle surface may be damaged, whereby a meniscus cannot be formed in some cases.

Moreover, in suction based on such a flow direction of an air stream, it is difficult to suck an ink or foreign particles remaining on surfaces along both sides of the nozzle string into the vacuum nozzle. For example, when an end portion of the suction opening is scanned for suction while being to touch the nozzle surface so that a negative pressure entirely acts on the nozzles, clogging of the nozzles can be eliminated. However, scanning movement of the suction opening causes an air stream to flow along a scanning direction and pass to cut longitudinally an upper side of the plurality of nozzles, which is the same as the above-described structure.

In Japanese patent No. 3065818, some of the nozzles are covered with and sucked by the sucking portion and the sucking portion is moved to suck all the nozzles, but a detailed shape of the sucking portion which covers the nozzles, especially a positional relationship between an orifice surface and the sucking portion is not clearly disclosed. When the sucking portion is appressed against a head surface to perform suction, a negative pressure entirely acts on the nozzles, and hence the inside of the nozzles can be sucked to eliminate clogging, but there is no guarantee that foreign particles or contamination which has adhered to a peripheral part of the nozzles can be removed, which may possibly result in the same inconvenience as that in Japanese Patent No. 316050.

BRIEF SUMMARY OF THE INVENTION

The present invention provides a maintenance apparatus of a recording head, which removes foreign particles or an unnecessary ink which has adhered to the inside or the vicinity of nozzles of the recording head in an image recording apparatus, thereby realizing maintenance processing over an entire nozzle surface.

The maintenance apparatus of a recording head is applied to an inkjet recording head having a nozzle plate on which many nozzles which discharge an ink are linearly arranged, and comprises a sucking portion which is provided to face the nozzle plate and exerts a suction force with respect to at least one of the nozzles and the nozzle plate, the sucking portion exerting the suction force to at least one of the nozzles and the nozzle plate in a direction crossing a discharge direction of the ink discharged from the nozzles.

The maintenance apparatus of a recording head is applied to an inkjet recording head having a nozzle plate on which many nozzles which discharge an ink are linearly arranged, and comprises a sucking portion which is provided to face the nozzle plate and exerts a suction force with respect to at least one of the nozzles and the nozzle plate, the sucking portion being provided to face an air intake portion which exerts a suction force with respect to at least one of the nozzles and the nozzle plate with the linearly arranged nozzles therebetween.

The maintenance apparatus of a recording ink has: a recording head which has a plurality of linearly arranged nozzles and a nozzle plate on which the nozzles are formed; a sucking portion which covers some of the plurality of nozzles of the recording head and generates an air stream required to suck an ink; and a scanning mechanism which moves the sucking portion along a nozzle arrangement direction, wherein the sucking portion generates the air stream at a position where the air stream faces the nozzles in such a manner that the air stream flows in a direction orthogonal to an ink discharge direction and a direction crossing the nozzle arrangement direction.

BRIEF DESCRIPTION OF THE SEVERAL VIEWS OF THE DRAWING

FIG. 24 is an enlarged cross-sectional view showing a primary part of the inkjet recording head and the sucking portion used in the fifth embodiment;

FIG. 25 is an enlarged cross-sectional view showing a primary part in the vicinity of a discharge nozzle of an inkjet recording head used as a comparative example of the fifth embodiment;

FIG. 26 is an enlarged cross-sectional view showing a primary part in the vicinity of the discharge nozzle of the inkjet recording head used as the comparative example of the fifth embodiment;

FIG. 38 is a view showing an outline configuration of a primary part of a sucking portion applied to an eighth embodiment according to the present invention;

FIG. 39 is a view showing an outline configuration of a primary part of the sucking portion applied to the eighth embodiment; and FIG. 40 is a view showing an outline configuration of an example of a conventional head maintenance apparatus.

DETAILED DESCRIPTION OF THE INVENTION

Embodiments according to the present invention will now be described hereinafter with reference to the accompanying drawings.

Figure 1:
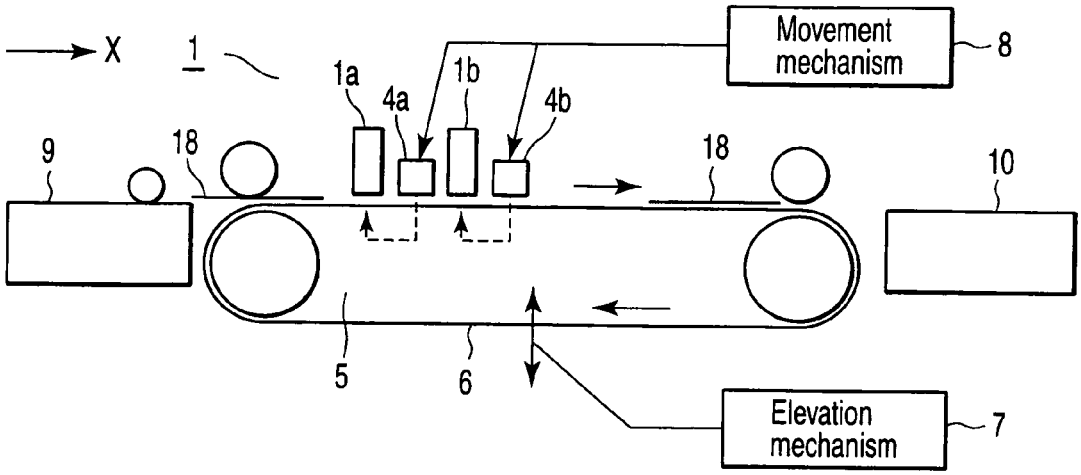
FIG. 1 is a view showing a conceptual configuration of a recording head and a maintenance apparatus of an image recording apparatus according to a first embodiment of the present invention.
Figure 2:
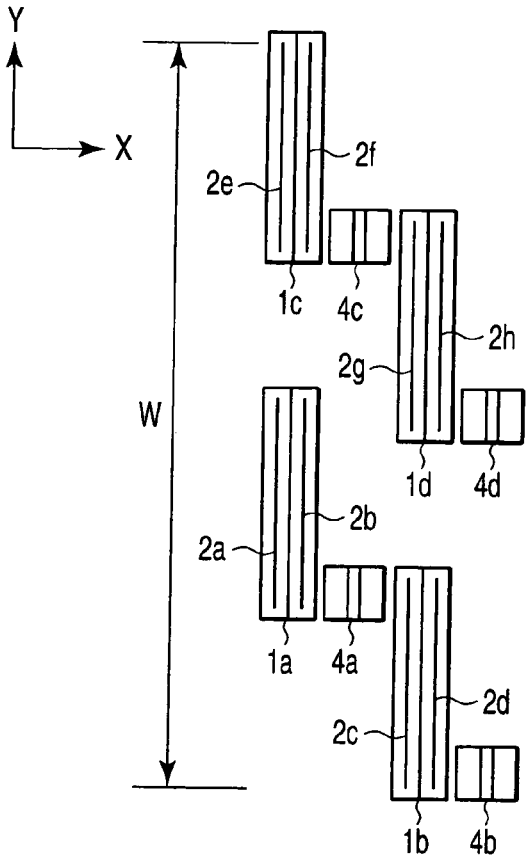
FIG. 2 is a layout plan showing the recording head in the first embodiment from a lower side (a nozzle side)
Figure 3:
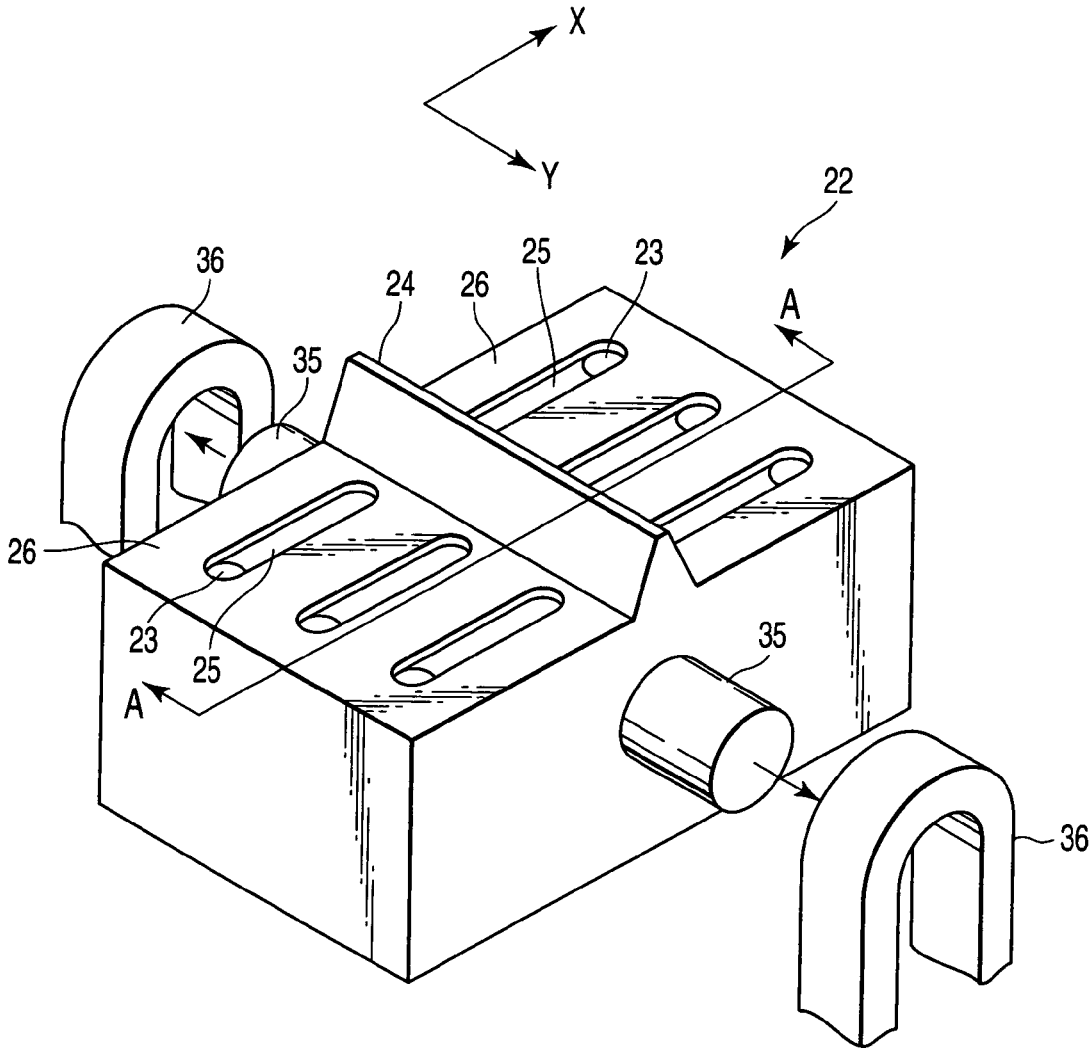
FIG. 3 is an appearance block diagram showing a sucking portion of the maintenance apparatus in the first embodiment from a side where the sucking portion is brought to touch the recording head.
Figure 4:
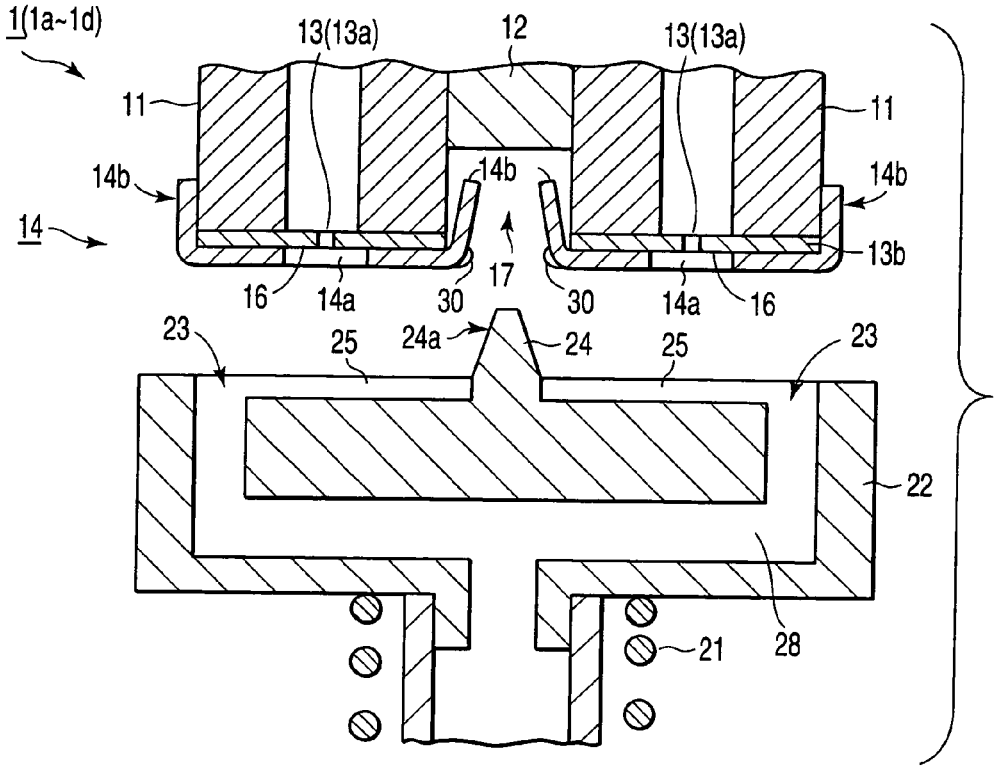
FIG. 4 is a view showing a state in which the recording head faces the maintenance apparatus when performing maintenance in the first embodiment (a cross section taken along A-A in FIG. 3)
Figure 5:
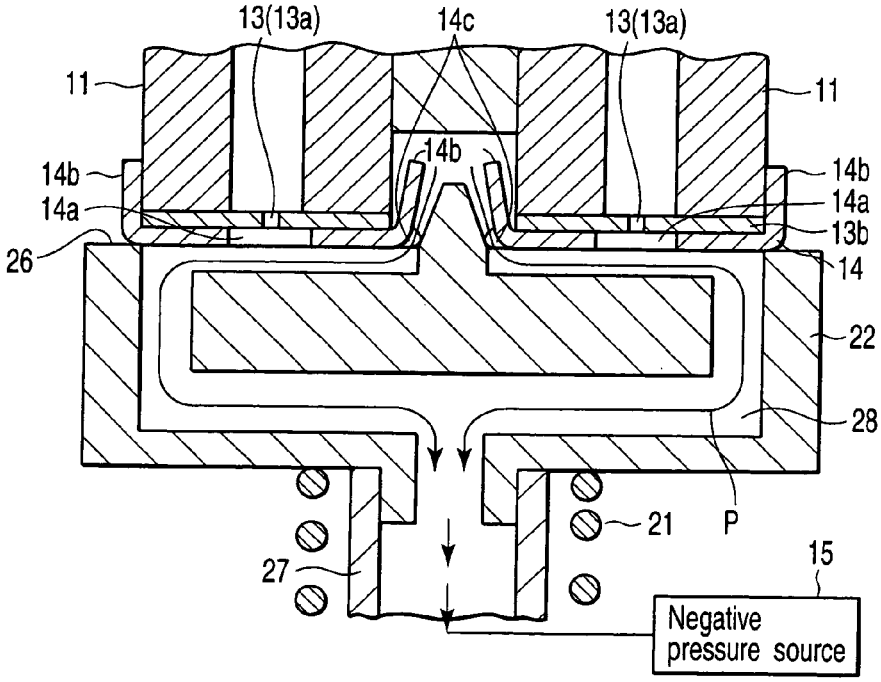
FIG. 5 is a view showing state in which the recording head is to touch the maintenance apparatus to perform maintenance in the first embodiment (the cross section taken along A-A in FIG. 3)

FIG. 1 is a view showing a conceptual configuration of a recording head and a maintenance apparatus of an image recording apparatus according to a first embodiment of the present invention, and FIG. 2 is a layout plane showing the recording head from a lower side (a nozzle side). Further, FIG. 3 is an appearance block diagram showing a sucking portion of the maintenance apparatus from a side where the sucking portion comes to touch the recording head, FIG. 4 is a view showing a state in which the recording head (a cross-sectional view) faces the maintenance apparatus in a cross-sectional view taken along A-A in FIG. 3 when performing maintenance, and FIG. 5 is a view showing a state in which the recording head is to touch the maintenance apparatus to perform maintenance.

In the following description, it is determined that a direction in which a plurality of nozzles (opening portions) from which the recording head discharges an ink are arranged is a nozzle string direction (a direction cutting longitudinally the nozzle string) or a Y axis direction or a longitudinal direction of a head main body, and a direction orthogonal to this direction is a recording medium carriage direction or an X direction or a width direction of the head main body. It is to be noted that a description will be given while exemplifying an inkjet recording head as the recording head in this embodiment.

As shown in FIG. 2, as the recording head mounted in this image recording apparatus, a plurality of recording heads 1 (1*a* to 1*d*), in each of which two of nozzle strings 2 (2*a* to 2*h*) whose length is shorter than a width W of a recording medium are arranged, are provided on front and back sides of the carriage direction and also alternately arranged in two lines along the width W direction of the recording medium. Maintenance apparatuses 4 (4*a* to 4*d*) are arranged in the vicinity of the respective recording heads 1*a* to id, e.g., on a downstream side in the carriage direction. These maintenance apparatuses 4 are moved down, then translated to a position where they face the recording heads 1 on an upstream side and further moved up by a movement mechanism 8, whereby a sucking portion main body of each maintenance apparatus 4 comes to touch each recording head 1. Moreover, each maintenance apparatus 4 has a later-described scanning mechanism which performs suction scanning with respect to the sucking portion main body.

These recording heads 1*a* to 1*d* are fixed heads, and discharge an ink with respect to a recording medium 18, e.g., a recording paper sheet or a film which is sucked and carried by a platen belt 6 of a transfer mechanism 5 which is provided to face each recording head, thereby recording an image, a character and others. This transfer mechanism 5 has an elevation mechanism 7, hence moves down to be retracted when performing maintenance processing by the maintenance apparatus 4, and also performs lifting/lowering of the maintenance apparatus.

In regard to a timing of forming an image by using these recording heads 1*a* to 1*d*, since the recording heads 1*a* to 1*d* are arranged on both the upstream side and the downstream side with respect to the carriage direction, an ink discharge timing is controlled based on distances between these recording heads and a carriage speed of the recording medium 18, whereby the ink can be appropriately superimposed on an image. Incidentally, to the image recording apparatus according to this embodiment are provided a recording medium supply portion 9 which sequentially supplies one recording medium 18 each time and a recording medium accommodating portion 10 which accommodates therein the recording medium 18 ejected after forming an image thereon.

The recording heads 1 will now be described with reference to FIGS. 2 and 4.

Two head main bodies 11 sandwich one heat sink 12 to integrally constitute each of the recording heads 1*a* to id. These head main bodies 11 are connected with a non-illustrated ink tank. The head main bodies 11 has a nozzle plate 13*b* on which a nozzle string 13*a* in which a plurality of nozzles 13 for discharging the ink are linearly arranged is formed, and an element (not shown) which discharges ink droplets by an on/off operation in accordance with image information input thereto is provided in each nozzle 13.

The heat sink 12 couples the two head main bodies 11 with each other in parallel with the recording medium 18 to be carried. At this time, a concave portion is formed with respect to nozzle surfaces 16 of the head main bodies 11 in a direction apart from the recording medium 18 (the Y axis direction), and a space 17 is provided at this portion. The heat sink 12 is formed of a material which can readily transmit heat, e.g., a metal, used to maintain a predetermined distance in parallel with the recording medium 18, and functions to let heat generated in the head bodies 11 to escape to a case side of the apparatus.

The plurality of nozzles 13 are opened on a tabular plate surface. This nozzle plate 13*b* has a configuration in which a liquid repellent processed thin film required for stabilization of an image forming operation covers a surface thereof. Further, a nozzle guard 14 in an air stream (or an air current) restricting member is further provided on the surface thereof. A long slit 14*a* is opened at a central part in this nozzle guard 14 in such a manner that the nozzle surface 16 including a discharge opening is exposed. Furthermore, both end portions 14*b* are extended in the width direction of the nozzle surface 16 and upwardly bent, and the inner side of the nozzle guard 14 has a sharper angle than an angle of a protruding portion inclined surface 24*a* of a protruding portion 24 which is required for later-described engagement. Moreover, a plurality of spacers 30 for later-described positioning are provided at a bottom portion on the inner side.

As shown in FIG. 5, when this nozzle guard 14 comes to touch a contact surface portion 26 of the maintenance apparatus 4, this contact surface portion 26 is substantially appressed against the nozzle guard 14 and, on the other hand, the nozzle surface 16 is not appressed against the contact surface portion 26 due to a thickness of the nozzle guard 14. Producing this non-appressed state allows the maintenance apparatus 4 to move for scanning without coming into contact with the surface of the nozzle plate 13*b*, thereby avoiding occurrence of a damage to the nozzle surface 16. It is to be noted that, when the nozzle guard 14 is engaged with the protruding portion 24, a small gap which functions as a flow path of air is formed by the later-described spacer 30 between a base portion 14*c* at which the inner end portion 14*b* of each of the two nozzle guards 14 and a base portion of the protruding portion 24.

Figure 6A:
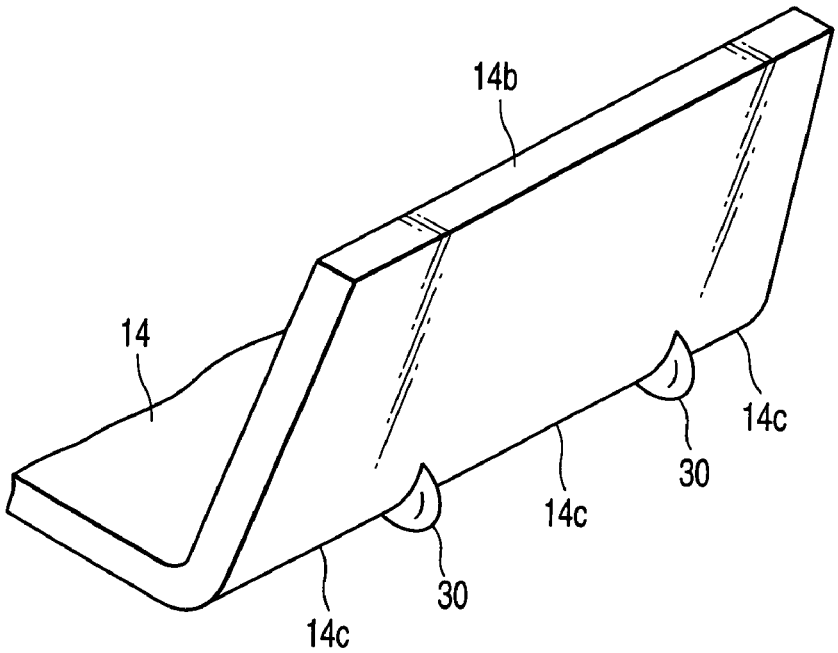
FIG. 6A is a view showing an appearance configuration of a nozzle guard having a spacer provided thereto in the first embodiment.
Figure 6B:
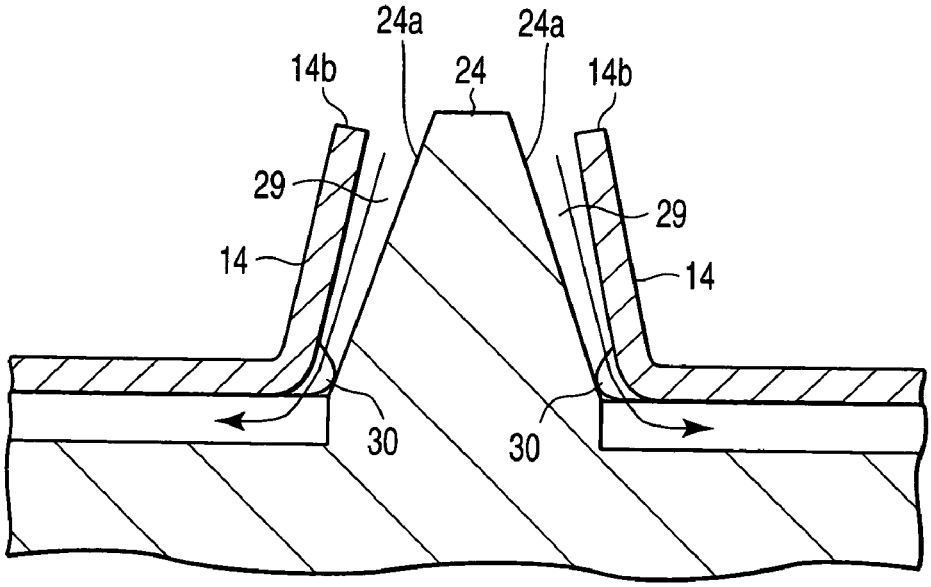
FIG. 6B is a view showing a state in which the nozzle guard is attached to the maintenance apparatus.

As shown in FIGS. 6A and 6B, the plurality of spacers 30 which avoid the appressed state with respect to the protruding portion inclined surface 24*a* of the protruding portion 24 may be provided at the inner end portion 14*b* of the nozzle guard 14 for later-described suction. Providing this spacer 30 can generate equal gaps 29 on both sides of the protruding portion 24 when the nozzle guard 14 is engaged with the protruding portion 24. Each of these gaps 29 forms a wedge-shaped cross section (a triangular cross section) extending from the protruding portion inclined surface 24*a* and the bottom portion 14*c* of the end portion 14*b* to the end portion 14*b*.

Figure 7A:
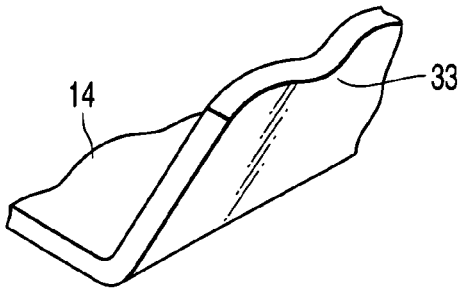
FIG. 7A is a view showing a first modification of the nozzle guard.
Figure 7C:
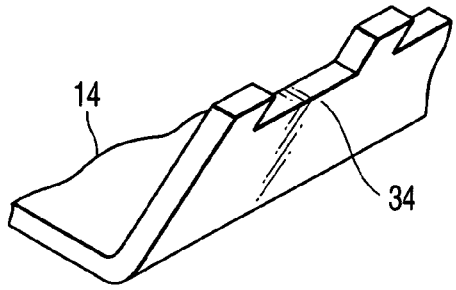
FIG. 7C is a view showing a state in which the nozzle guard according to the first modification is attached to the maintenance apparatus.
Figure 7B:
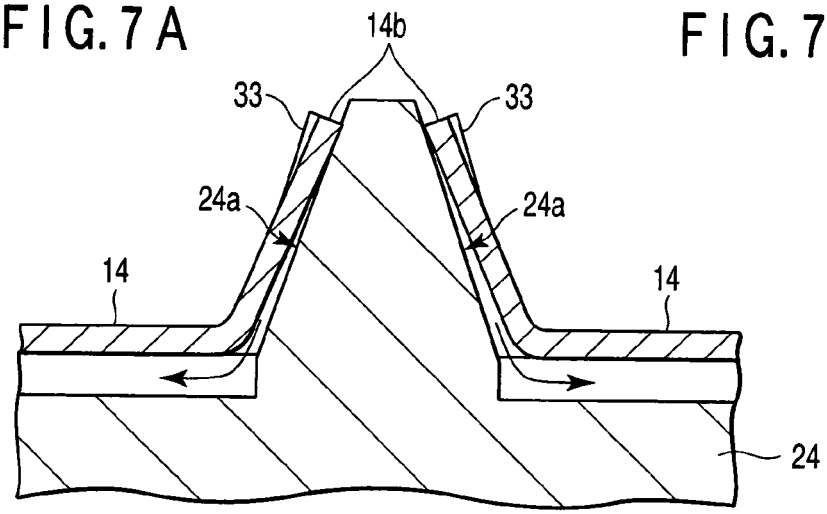
FIG. 7B is a view showing a second modification of the nozzle guard.

Additionally, as a modification of the end portion 14*b*, a leading end part of the inner end portion 14*b* of the nozzle guard 14 is configured to move while coming to touch the protruding portion inclined surface 24*a*, the leading end part of the inner end portion 14*b* of the nozzle guard 14 may be formed into, e.g., a corrugated shape as shown in FIGS. 7A and 7B so that an intake opening is formed when the end portion 14*b* is brought to touch the protruding portion inclined surface 24*a*. Likewise, as shown in FIG. 7C, a concave portion 34 may be formed at the leading end part of the end portion 14*b* to form the intake opening. Such an intake opening is formed in order to generate an air stream for later-described suction.

The maintenance apparatus will now be described with reference to FIGS. 3 to 8.

Figure 8:
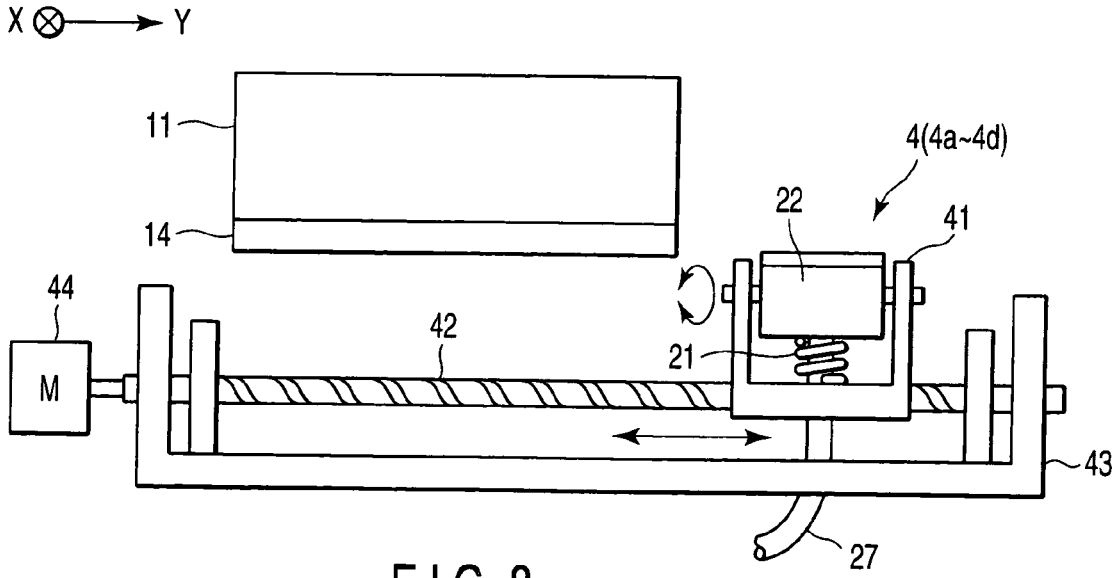
FIG. 8 is a view showing an appearance configuration of a scanning mechanism of the maintenance apparatus in the first embodiment.

FIG. 8 shows an appearance configuration of the scanning mechanism in the maintenance apparatus.

As shown in FIG. 8, each of the maintenance apparatuses 4*a* to 4*d* is comprised of a sucking portion main body 22 supported in a maintenance support 41 by a bias spring 21 and a maintenance frame body 43 which movably supports these members along a nozzle string direction of the recording heads 1*a* to 1*d*.

As shown in FIG. 4, in the sucking portion main body 22, the protruding portion 24 which engages with the head main body 11 and restricts an attitude of the sucking portion main body 22 with respect to the head main body 11 is provided in such a manner that the sucking portion main body 22 moves for scanning while maintaining a predetermined positional relationship with respect to the nozzle string 13*a* of the two head main bodies 11. As described above, during maintenance, the protruding portion 24 moves up from a FIG. 4 position where each of the maintenance apparatuses 4*a* to 4*d* faces the recording head 1 and engages with the space 17 formed by the heat sink 12 as shown in FIG. 5.

Further, as shown in FIG. 3, cylindrical stopper protruding portions 35 are provided to the sucking portion main body 22 on both end sides (the Y axis direction) of the protruding portion 24, and these stopper protruding portions 35 are fitted in a cap-shaped (U-shaped) stopper portions 36 provided to the maintenance support 41 (FIG. 8) in such a manner that the stopper protruding portions 35 can oscillate. This stopper portion 36 restricts the sucking portion main body 22 to move beyond a predetermined position. Furthermore, since the sucking portion main body 22 is supported to receive an impetus by the bias spring 21, an appropriate appressed state can be provided when the sucking portion main body 22 comes to touch the recording head 1 even if the nozzle surface is slightly inclined.

Moreover, a plurality of suction openings 23 and suction grooves 25 are provided to the sucking portion main body 22 on both sides thereof with the protruding portion 24 at the center. These suction grooves 25 are arranged to face each other in such a manner that the suction grooves 25 are positioned in a direction substantially orthogonal to the nozzle strings 2 of the two head main bodies 11 in an engaged state where the protruding portion 24 is to touch the recording head 1.

Additionally, the three suction grooves 25 are provided with respect to one head main body 11 in this embodiment, and the suction grooves 25 are arranged in parallel with each other at predetermined intervals in the nozzle string direction. As shown in FIGS. 5 and 6, when each suction groove 25 is appressed against the nozzle guard 14, the inside of the suction groove 25 is spatially connected with the gap 29. Furthermore, the contact surface portion 26 of the sucking portion main body 22 which comes to touch the head main body 11 is formed into a flat surface. During maintenance, the contact surface portion 26 is pressed against the surface of the nozzle guard 14 by the bias spring 21 to provide an appressed state in which the contact surface portion is welded by a preferable pressure. The suction opening 23 is opened on one end side in the suction groove 25. Moreover, a flow path 28 through which air is discharged from the suction opening 23 to a negative pressure source 15 including a non-illustrated suction pump via a duct 27 is formed in the sucking portion main body 22.

Therefore, in this embodiment, since the suction openings 23 are provided on both outer sides, an air stream outwardly flows from the protruding portion 24 side provided at the center on the nozzle surface. Accordingly, this sucking portion main body 22 is formed in such a manner that an air stream to be generated flows over the entire width of the nozzle guard 14 in a direction crossing the nozzle string 13*a*.

In this embodiment, each of the maintenance apparatus 4*a* to 4*d* has such a scanning mechanism as shown in FIG. 8. This sucking portion main body 22 is attached to the maintenance support 41 so that it can swing, and supported in a state where it is pressed by the bias spring 21. This maintenance support 41 is supported with respect to the maintenance frame body 43 through a feed screw 42 arranged in the Y axis direction. A motor 44 is coupled on one end side of the feed screw 42. When the motor 44 rotates the feed screw 42, the maintenance support 41 can reciprocate with respect to the maintenance frame body 43 along the feed screw 42.

Additionally, the maintenance apparatus 4 (the maintenance frame body 43) can move in the carriage direction by the movement mechanism as shown in FIG. 1, and utilizes the elevating mechanism 7 in the transfer mechanism 5 to move up and down so that the sucking portion main body 22 can come to touch the nozzle guard 14 surface of the head main body 11. In this example, the maintenance frame body 43 is configured to be suspended from a non-illustrated member in which the head main body 11 is arranged in such a manner that it can move in up/down and right/left directions by a predetermined amount through a non-illustrated guide member in FIG. 8, and the maintenance frame body 43 is mounted on the transfer mechanism 5, for instance. After the mounted maintenance frame body 43 is moved down by the elevation mechanism of the transfer mechanism 5, the maintenance frame body 43 provided in the guide member is moved to a position where it faces the head main body 11 by the lateral movement mechanism 8 (a motor or the like), and upward movement of the elevation mechanism 7 of the transfer mechanism 5 allows touch of the sucking portion main body 22.

The above-described configuration of the recording head 1 and the maintenance apparatus 4 allows a generated air stream P to pass transversely across the nozzle string 13*a* and flows to cut across one nozzle 13 alone in the suction groove 25. Further, as the sucking portion main body 22 or the member forming the contact surface portion 26, it is appropriate to utilize one which has water-resisting properties or ink-resisting properties in accordance with characteristics of an ink to be used, is readily formed and processed and has a small friction coefficient in order to smoothly move for scanning on the surface of the nozzle guard 14.

Furthermore, it is preferable to provide a configuration which improves a degree of close contact in accordance with a shape (a degree of flatness or the like) of the nozzle guard 14. As means for increasing the degree of close contact, it is preferable to form the contact surface portion of a material softer than the nozzle guard 14 or an elastic member as shown in a later-described third embodiment.

A description will now be given as to maintenance processing by the image recording apparatus on which the thus configured maintenance apparatus is mounted with reference to FIGS. 1 to 8.

First, when a user appropriately or periodically instructs maintenance processing, the transfer mechanism 5 (the platen belt 6) moves down apart from the recording head 1 by the elevation mechanism 7 as shown in FIG. 1. Then, the maintenance frame body 43 is moved from an accommodation position to a position where it faces each of the recording heads 1*a* to id by the movement mechanism 8. In this example, since the maintenance frame body 43 is accommodated on the downstream side surface in a paper transfer direction of the recording heads 1*a* to 1*d*, the maintenance frame body 43 is moved down, then moved in parallel along an upstream side, and stopped at the position where it faces each of the recording heads 1*a* to 1*d*.

Thereafter, the elevation mechanism 7 moves up the transfer mechanism 5. This upward movement allows the transfer mechanism 5 to push up the maintenance frame body 43, and the sucking portion main body 22 is engaged with the head main body 11 as described above. At this time, the sucking portion main body 22 is pressed by the bias spring 21, and the sucking portion main body 22 is pushed and appropriately appressed against the nozzle guard 14. In this appressed state, the inside of the suction groove 25 is spatially coupled with the gap 29.

Then, a negative pressure is generated (sucked) by the negative pressure source 15 as shown in FIG. 5 to produce the air stream P which reaches the negative pressure source 15 from the gap 29 through the suction groove 25, the suction opening 23, the flow path 28 and the duct 27.

This generated air stream P crosses the nozzle string 13*a* to cut across several nozzles 13 alone when air sucked from the gap 29 passes through the suction groove 25 in a state where the surface of the nozzle guard 14 is covered.

In such a state where the sucking portion main body 22 is appressed against the nozzle guard 14 and the negative pressure is generated, the motor 44 rotates the feed screw 42 as shown in FIG. 8 so that the maintenance support 41 moves along the feed screw 42. Owing to this scanning movement, the air stream under the negative pressure of the sucking portion main body 22 with respect to the entire surface of the head main body 11 on the nozzle surface side flows in from the gap 14*c* for inflow of outside air formed at the bottom part of the protruding portion 24, so that the air stream sucks, from the suction opening 23, attachments (foreign particles, residual ink droplets, an ink spill and others) on the nozzle guard 14 surface facing the groove, on the nozzle plate 13*b* surface of the head main body 11, and in the vicinity of the nozzles 13 while flowing in the suction groove 25, and then discharges them to the negative pressure source 15 side through the flow path 28 and the duct 27. The sucked attachments are collected in a non-illustrated waste liquid tank not shown.

As described above, the since the gap 29 has the wedge-shaped cross section extending from the base portion 14*c* of the nozzle guard 14 to the end portion 14*b*, a fluid speed of the air taken in by the negative pressure is increased when the air passes through the base portion 14*c*, and the air flows in the suction groove at this fluid speed. Therefore, suction is performed with the strong air stream, and attachments remaining on the nozzle surface 16 or the surfaces on both sides of the nozzle string can be sucked and removed. Moreover, since the air stream can also remove attachments at the edge of the nozzle guard 14 (an opposed surface portion), the residual ink does not remain on the nozzle guard 14 around the nozzles 13 when the sucking portion main body 22 is detached from the head main body 11 after completion of the maintenance processing.

After completion of the maintenance processing based on suction and removal with respect to the entire surface of the nozzle plate 13*b* of the head main body 11, driving of the feed screw 42 and driving of the negative pressure source 15 are stopped.

After stopping such driving, the transfer mechanism 5 is moved down by the elevation mechanism 7, and the maintenance frame body 43 is moved down apart from the head main body 11. Then, the maintenance frame body 43 is returned to the original accommodation position by the movement mechanism 8. Subsequently, in case of performing a recording operation, the transfer mechanism 5 is again moved up and arranged at an image recording position by the elevation mechanism 7. Alternatively, in case of terminating the recording operation, each constituent part is returned to its initial position, thereby completing a series of maintenance processing.

As described above, according to the maintenance apparatus in the image recording apparatus of this embodiment, since attachments (foreign particles such as dust or a residual ink) which are sucked and moved by an air stream cut across one nozzle alone, they do not pass through other nozzles or the nozzle surface, thereby avoiding generation of new clogging or a damage to the nozzle surface. Moreover, since an air stream flows from an end to the other end of the suction groove as described above, the residual ink or foreign particles such as dust can be sucked and removed from surfaces on both sides of the nozzle string. It is to be noted that the direction orthogonal to the nozzle string is formed as a longitudinal direction of the suction groove 25 in the drawings of this embodiment, but the present invention is not of course restricted thereto, forming an air stream to cross the nozzle string can suffice. Namely, generating an air stream which cuts across the nozzle string and flows to pass through one nozzle 13 alone can suffice, whereby the longitudinal direction of the suction groove 25 may be provided in, e.g., an oblique direction with respect to the nozzle string.

A second embodiment according to the present invention will now be described.

This embodiment is different from the first embodiment in a shape of the suction groove arranged in the sucking portion main body of the maintenance apparatus and an arrangement of the suction opening. It is to be noted that constituent parts other than the sucking portion main body are equivalent to the constituent parts of the first embodiment, and like reference numerals denote such parts, thereby eliminating their explanation.

Figure 9A:
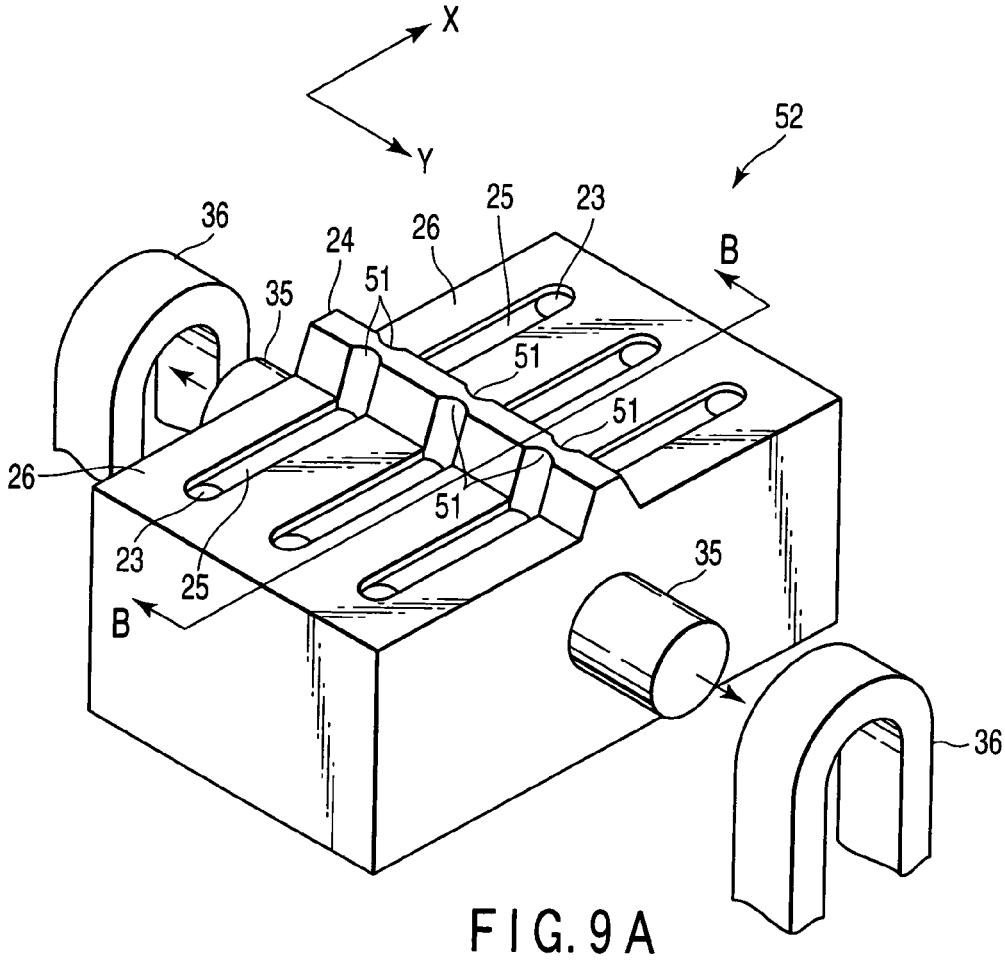
FIG. 9A is a view showing a structural example of a sucking portion main body of a maintenance apparatus according to a second embodiment of the present invention.
Figure 9B:
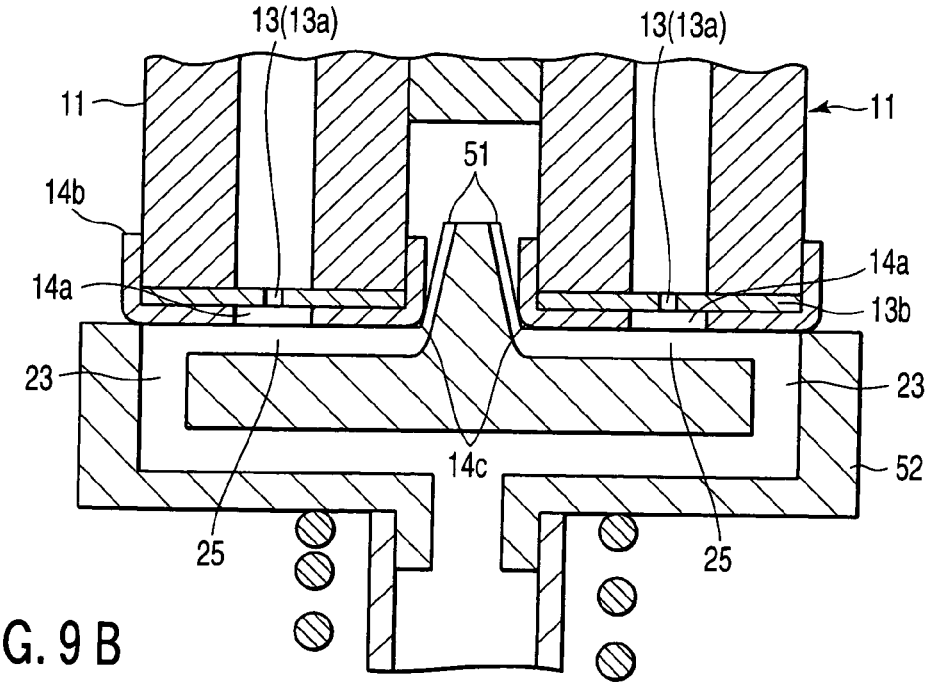
FIG. 9B is a view showing a cross section taken along B-B when the maintenance apparatus is to touch a recording head.

FIG. 9A shows a sucking portion main body 52 which is coupled with a protruding portion inclined surface 24*a* of a protruding portion 24 from a suction groove 25 and has each upwardly extending suction groove 51 provided thereto. FIG. 9B is a cross-sectional view taken along B-B in FIG. 9A, showing a state where a nozzle guard 14 of each head main body 11 is appressed against a sucking portion main body 52.

In the above-described first embodiment, when engagement is established, positioning is performed by providing the spacer 30 which prevents the end portion 14*b* of the nozzle guard 14 from being appressed against the protruding portion inclined surface 24*a*, thereby forming the uniform gap 29. On the contrary, since this embodiment allows positioning by which the protruding portion inclined surface 24*a* is directly appressed against and engaged with the nozzle guard 14, a positioning member such as a spacer is unnecessary. Air can be taken in from the suction groove 51 in a state where a base portion 14*c* of the nozzle guard 14 is appressed against the protruding portion inclined surface 24*a* to generate the above-described air stream, thus sucking and removing attachments. In this embodiment, like the first embodiment, the air stream flowing in a direction crossing the nozzle string prevents moving attachments from passing through the other nozzles or the nozzle plate surface, thereby avoiding generation of new clogging or a damage to the nozzle surface.

First and second modifications of the second embodiment will now be described.

Figure 10A:
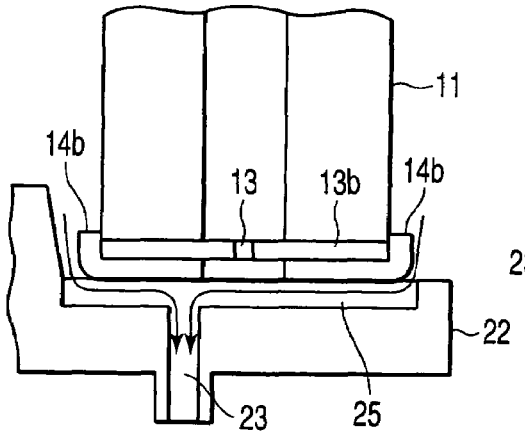
FIG. 10A is a view showing a first modification of the second embodiment.

Although the first embodiment is the example in which the suction opening 23 is formed at an outermost position in the suction groove 25, air may be taken in from both sides of a suction groove 25 and a suction opening 23 may be provided in the vicinity of the nozzle 13 in the first modification as shown in FIG. 10A. It is to be noted that the position of the suction opening 23 in this configuration may be any position in the suction groove 25 as long as it is a position other than that facing the nozzle 13.

Figure 10B:
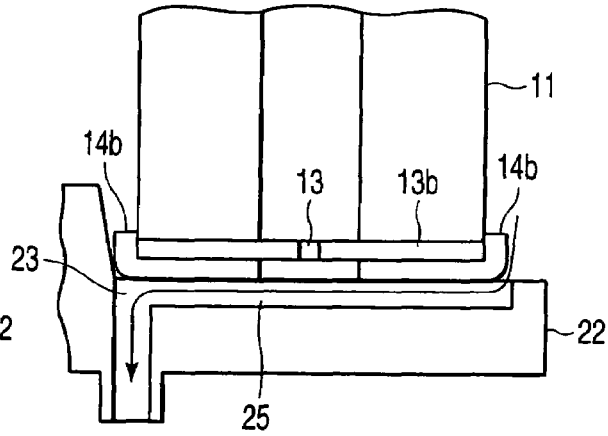
FIG. 10B is a view showing a second modification of the second embodiment.

Further, in contradiction to the first embodiment, a suction opening 23 may be formed at an innermost position in a suction groove 25 like the second modification shown in FIG. 10B. In this configuration, air is sucked from the outermost side, and an air stream flows to cut across a nozzle string from the suction opening 23 formed on the innermost side, thereby sucking and removing a residual ink or foreign particles such as dust.

Considering an arrangement position of the suction opening 23 in this manner can form an air stream which flows in from both sides of the nozzle guard 14 and, in particular, this arrangement is effective in removal of attachments at a corner portion such as a boundary portion between the nozzle surface and the nozzle guard where suction and removal using an air stream in one direction are difficult.

A third embodiment according to the present invention will now be described.

Figure 11:
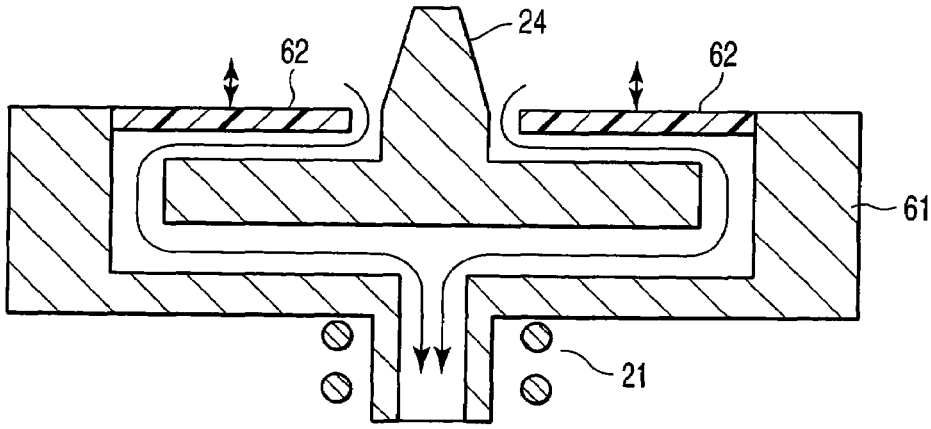
FIG. 11 is a view showing a structural example of a maintenance apparatus according to a third embodiment of the present invention.

This embodiment uses an elastic member as a contact surface portion 26 of a sucking portion main body as shown in FIG. 11. It is to be noted that constituent parts other than the sucking portion main body in this embodiment are equivalent to the constituent parts in the first embodiment, and hence like reference numerals denote these part, thereby eliminating their explanation.

In this embodiment, a contact surface portion of the sucking portion main body 61 is formed of an elastic member 62, e.g., a resin, rubber or the like whose hardness is lower than that of the nozzle guard.

According to this configuration, when the sucking portion main body 61 comes to touch the nozzle guard 14, the sucking portion main body 61 is pressed by a bias spring 21, and the elastic member 62 elastically deforms in accordance with a surface of the nozzle guard 14 and is finally appressed against the nozzle guard 14 while pushing out an attached ink or the like existing between the elastic member 62 and the contact surface of the nozzle guard 14. Therefore, since a degree of close contact with the nozzle guard 14 is improved by the elastic member 62, adhesion can be enhanced without increasing a component accuracy of the contact surface of the nozzle guard 14, thus efficiently removing the attached ink.

A fourth embodiment according to the present invention will now be described.

Figure 12A:
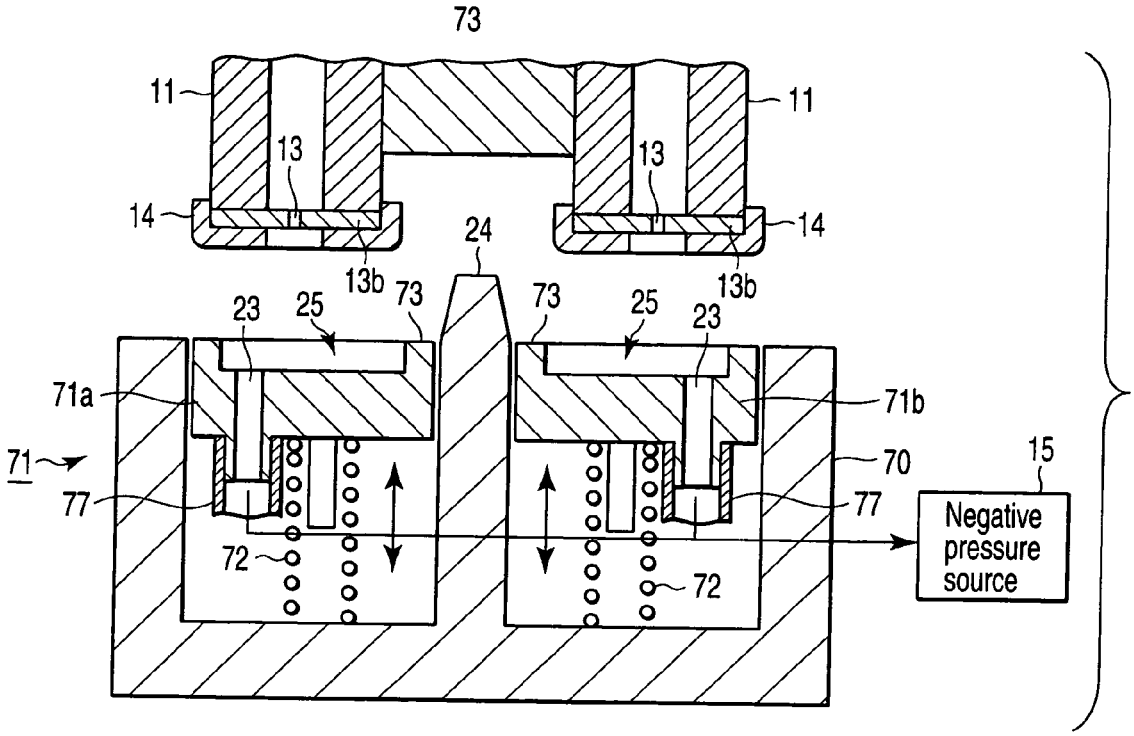
FIG. 12A shows a cross-sectional structural example of a maintenance apparatus according to a fourth embodiment of the present invention.
Figure 12B:
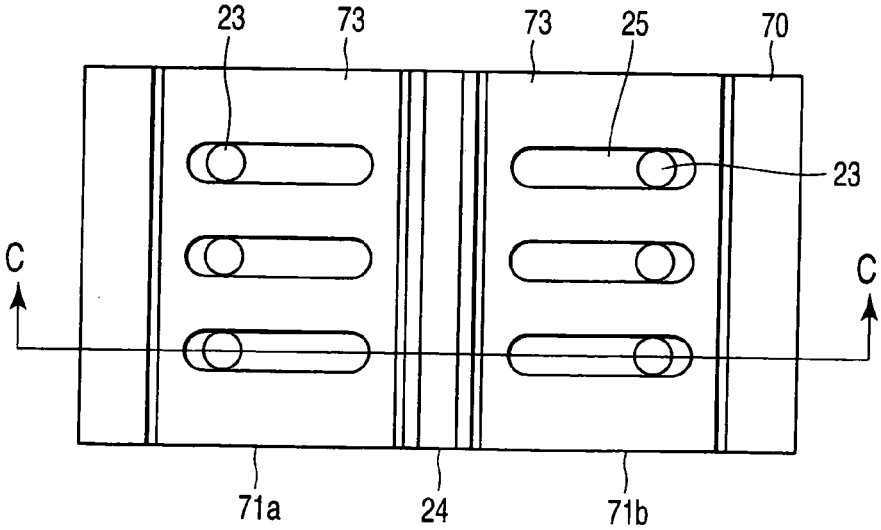
FIG. 12B is a view showing a configuration from above in this structural example.

FIG. 12A is a view showing a conceptual configuration (a cross section taken along C-C in FIG. 12B) of a sucking portion main body of a maintenance apparatus in an image recording apparatus according to a fourth embodiment, and FIG. 12B is an appearance view showing the sucking portion main body from above. The embodiment has a configuration in which an independent flow path having a suction groove 25 and a suction opening 23 and an independent spring are provided in accordance with each sucking portion main body 22 corresponding to one head main body 11. It is to be noted that constituent parts other than the sucking portion main body in this embodiment are equal to the constituent parts in the first embodiment, and like reference numerals denote these constituent parts, thereby eliminating their explanation.

In the fourth embodiment, bias springs 72 which independently elastically press a plurality of sucking portion main bodies 71 (71*a* and 71*b*) are provided.

As shown in FIG. 12A, the plurality of, e.g., two sucking portion main bodies 71*a* and 71*b* are respectively independently supported by the bias springs 72 in a maintenance support 70, and these sucking portion main body 71 are movably supported by a maintenance support 41 (see FIG. 8) along, e.g., a nozzle string direction of recording heads 1*a* to id (see FIG. 2). Further, two contact surface portions 73 which independently and individually come to touch the two head main bodies 11 are provided to these sucking portion main bodies 71. A plurality of suction grooves (three in one column in FIG. 12B) are provided in this contact surface portion 73, a suction opening 23 is formed in each of these grooves, and a tube 77 or the like is connected with a lower portion of the suction opening 23 so that each sucking portion 23 is connected with a negative pressure source 15 through the tube 77 or the like.

According to the above-described configuration, as compared with the case where the plurality of sucking portion main bodies are integrally constituted, the independent contact surface portion 73 of each sucking portion main body 71*a* or 71*b* is appressed against a nozzle guard 14 by a pressing force of the independent bias spring 72, thereby improving a degree of close contact.

Figure 13A:
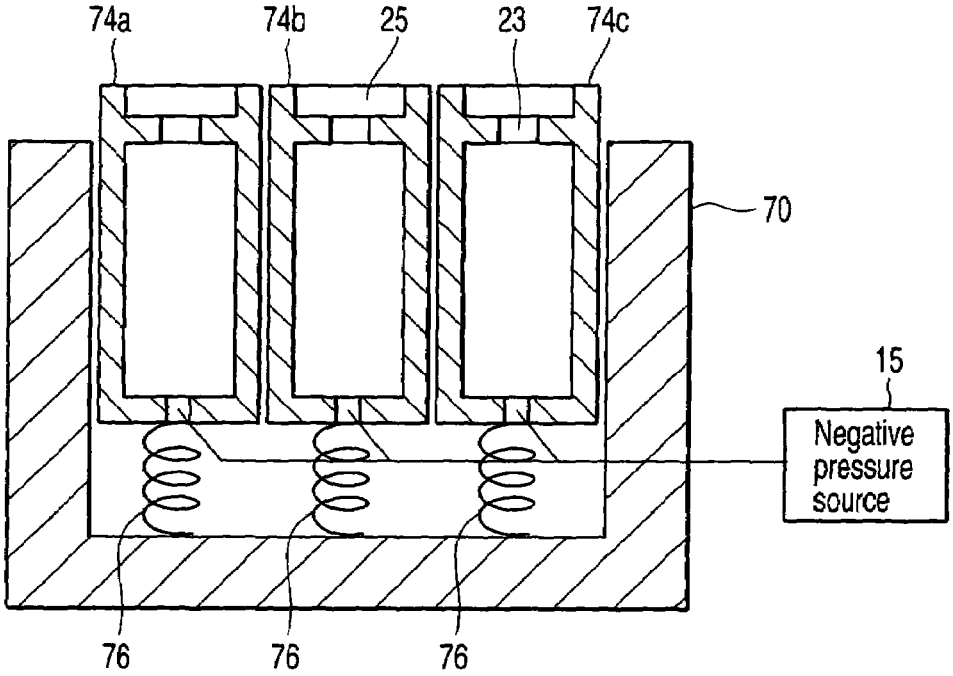
FIG. 13A shows a cross-sectional structural example in a first modification of the fourth embodiment.
Figure 13B:
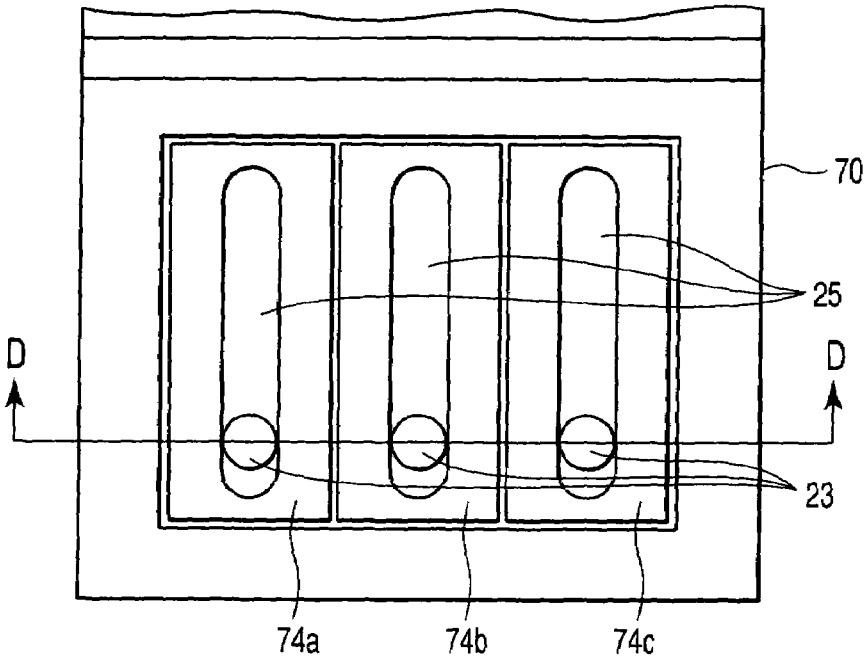
FIG. 13B is a view showing a configuration from above in this structural example.

Furthermore, as a first modification of the fourth embodiment, it is possible to adopt a configuration which independently operates in accordance with each of contact surface portions 74*a*, 74*b* and 74*c* which has a suction groove 25 as shown in FIGS. 13A and 13B. A bias spring 76 is provided to each of the contact surface portions 74*a*, 74*b* and 74*c* so that the contact surface portions can respectively independently come to touch the nozzle guard 14.

Adopting such a configuration can enables contact with the nozzle guard 14 at a smaller contact portion, and a degree of close contact with respect to the nozzle guard 14 can be improved without increasing a component accuracy of the nozzle guard 14. Incidentally, in regard to connection between a lower portion of each of the contact surface portions 74*a*, 74*b* and 74*c* and the negative pressure source 15, connection is achieved through a non-illustrated tube like FIG. 12 mentioned above.

This configuration can obtain the above-described effects in addition to the effects in each of the foregoing embodiments.

Figure 14:
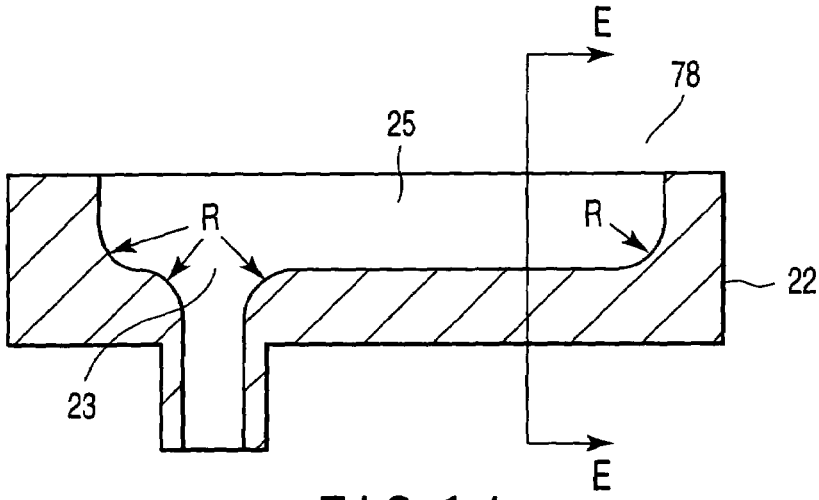
FIG. 14 is a view showing a modification of a sucking portion main body.

Further, in the first to fourth embodiments and the respective modifications of the second and fourth embodiments, as shown in FIG. 14, when roundness R is given around the intake opening in the vicinity of an inflow portion 78 for outside air of the sucking portion main body 22 or around the suction opening 23 facing the suction groove 25 to smoothen a flow of air, a pressure drop is decreased, thereby increasing the efficiency.

Figure 15:
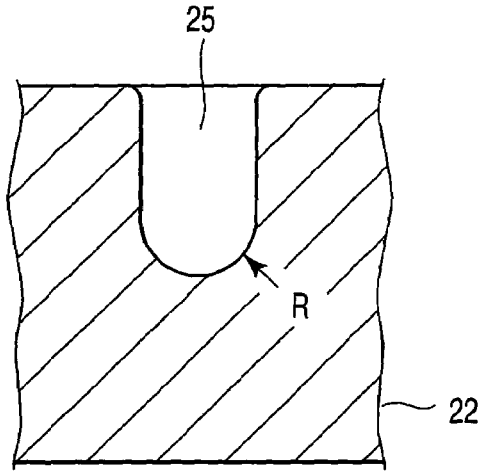
FIG. 15 is a view showing a modification of the sucking portion main body.

Furthermore, as shown in FIG. 15 illustrating a cross section taken along E-E in FIG. 14, giving roundness R to a corner angular portion of the suction groove 25 can also smoothen a flow of air to reduce a pressure drop. Moreover, a speed of an air stream flowing in the groove is mainly subject to a suction pressure and a cross-sectional shape. Maintaining a fixed air stream speed is essential for maintaining a cleaning effect constant.

Figure 16:
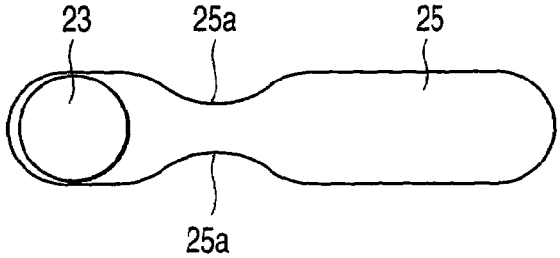
FIG. 16 is a view showing a modification of the sucking portion main body.

Therefore, it is preferable for a cross-sectional shape of the groove 25 to be uniform. For the same reason, it is desirable to provide a buffer between a pump which generates a negative pressure and the suction opening to prevent a negative pressure acting on the suction opening 23 and the suction groove from being fluctuated. On the contrary, in order to improve recovery from clogging of the nozzle 13 of the head main body 11 or an ink suction effect from the nozzle 13, as shown in FIG. 16, a bulge portion 25*a* can be formed in a cross-sectional shape of the suction groove 25 at a part around the nozzle 13 to narrow an air stream so that a speed of an air stream in the suction groove can be increased and a suction force with respect to the nozzle 13 can be improved. A narrowing method or a shape of the cross section is not particularly restricted.

According to the foregoing embodiments and modifications, since an air stream is caused to flow in a direction cutting across the nozzle string of the respective nozzles in the head main body to suck and remove attached foreign particles or an ink containing dust, it is possible to avoid a damage to the head nozzle, the head nozzle surface, the liquid repellent processed thin layer or the like on the head main body end surface which does not operate during suction.

Moreover, since the contact surface portion of the sucking portion main body is configured to be appressed against the nozzle guard, it is possible to avoid a reduction in negative pressure due to inflow of air from the contact surface portion.

Additionally, since the nozzle guard is appressed against the contact surface portion without a gap therebetween, the ink remaining on the nozzle guard is also sucked. Since an edge part of the appressed portion is configured to face the suction groove through which an air stream for suction flows, the ink which has adhered to the edge by suction of a strong air stream can be completely sucked and removed. As a result, residual ink droplets do not remain on the nozzle guard when the sucking portion main body is detached from the head main body.

Further, it is possible to perform not only suction of the head nozzle and the head nozzle surface but also removal of dust or an ink over the entire width of the nozzle guard, an inconvenience of dust or the ink on the nozzle guard which adheres to and contaminates the recording medium during image recording can be avoided.

Figure 17A:
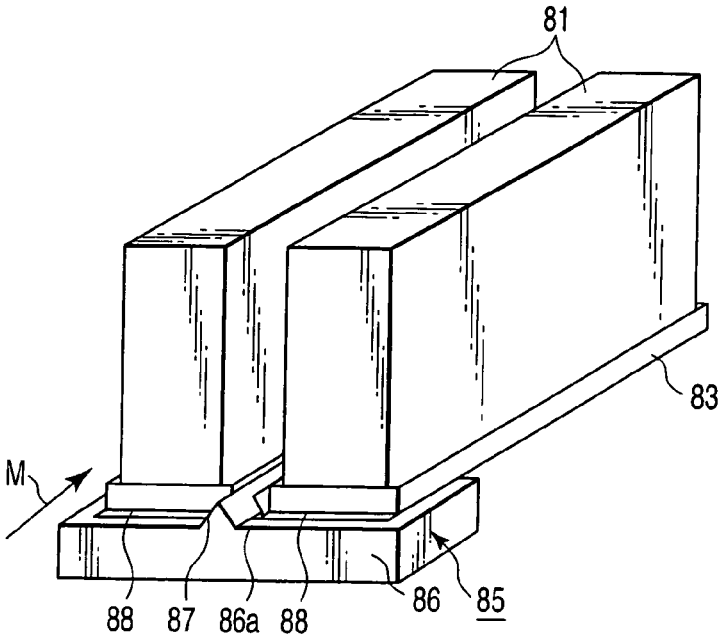
FIG. 17A is a schematic block diagram showing a head maintenance apparatus according to a fifth embodiment of the present invention.
Figure 17B:
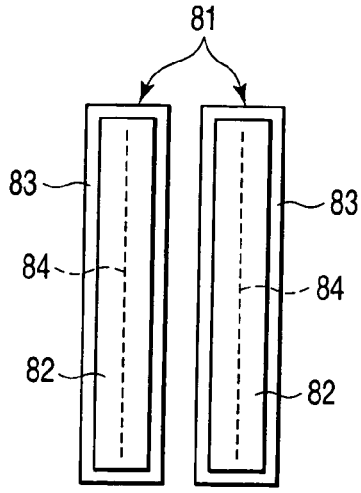
FIG. 17B is a view showing a nozzle surface of a recording head.

FIGS. 17A and 17B are schematic block diagrams of a maintenance apparatus of a recording head according to a fifth embodiment of the present invention.

In FIG. 17A, an inkjet type recording head 81 has a configuration in which a tabular nozzle plate 82 is provided on a lower surface side as shown in FIG. 17B and a nozzle guard 83 having a rectangular opening portion is provided around this nozzle plate 82. In this configuration, the nozzle guard 83 slightly protrudes with respect to the nozzle plate 82, and a difference between the nozzle guard 83 and the nozzle plate 82 is, e.g., approximately 0.1 mm. The difference in this example is not restricted to the above-described value as long as a later-described sucking portion 85 does not directly come to touch the nozzle plate 82. Actually, a thickness of the nozzle guard 83 is the difference. Furthermore, many nozzles 84 are linearly arranged at a central part of the nozzle plate 82 surrounded by the nozzle guard 83.

The sucking portion 85 of the maintenance apparatus according to this embodiment is arranged to face the nozzle plate 82 below such a recording head 81.

The sucking portion 85 in this example corresponds to the two recording heads 81 arranged in parallel as shown in FIG. 17A, can come to touch a surface of the nozzle guard 83 of each of these recording heads 81, and is moved along an arrangement direction (a direction indicated by an arrow M in the drawing) of the nozzles 84 with respect to the nozzle plate 82 in this state to remove foreign particles or an excess ink which has adhered to each nozzle 84.

Figure 18:
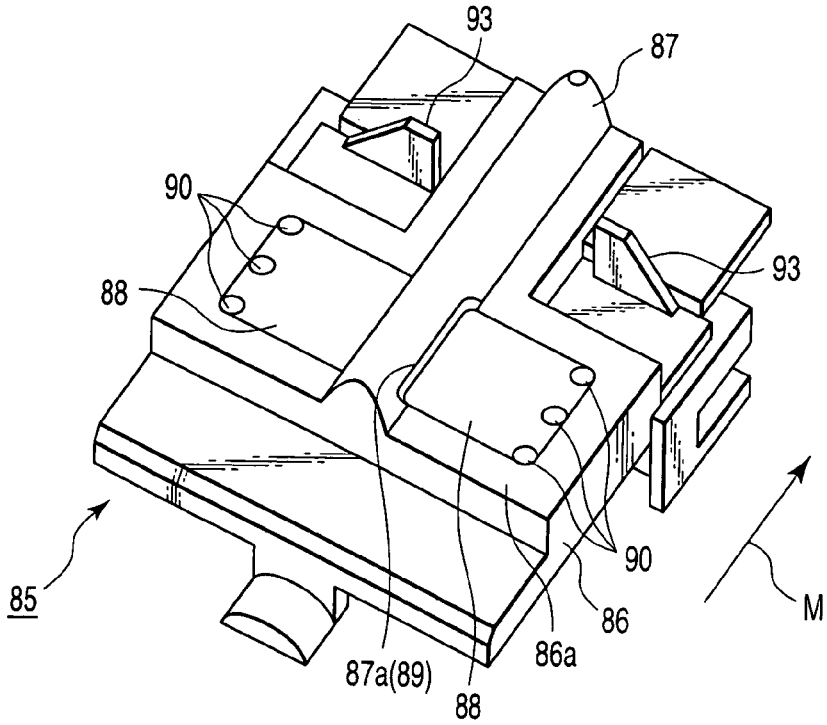
FIG. 18 is a view showing an outline configuration of a sucking portion used in the fifth embodiment.

FIG. 18 shows an outline configuration of the sucking portion 85.

In FIG. 18, a positioning rib 87 is provided at a central part of an upper surface 86*a* of a sucking portion main body 86. The positioning rib 87 is arranged along a movement direction of the sucking portion 85 and formed to have a triangular cross section. Furthermore, the positioning rib 87 is placed between the two recording heads 81 when the sucking portion 85 comes to touch the recording heads 81, and positions these recording heads 81 in a direction orthogonal to the arrangement direction (the direction indicated by the arrow M in FIG. 18) of the nozzles 84.

Two suction opening portions 88 are provided with the positioning rib 87 therebetween on the upper surface 86*a* of the sucking portion main body 86. These suction opening portions 88 suck and remove foreign particles or an extra ink which has adhered to the nozzles 84 or the nozzle plate 82 in a state where the surface of the nozzle guard 83 of each recording head 81 is to touch the upper surface 86*a* of the sucking portion main body 86, and each of the suction opening portion 88 is formed of a concave portion having a step of approximately 1 mm from the upper surface 86*a*.

A notch portion 87*a* is provided at a base end portion of the positioning rib 87 at one end portion of the suction opening portion 88, and an air intake opening 89 is formed in this notch portion 87*a*. This air intake opening 89 is a rectangular opening portion which is formed of a gap between the notch portion 87*a* of the positioning rib 87 and the recording head 81 in a state where the sucking portion 85 is to touch the recording head 81, i.e., a state where the upper surface 86*a* of the sucking portion 85 is to touch the recording head 81.

Figure 19:
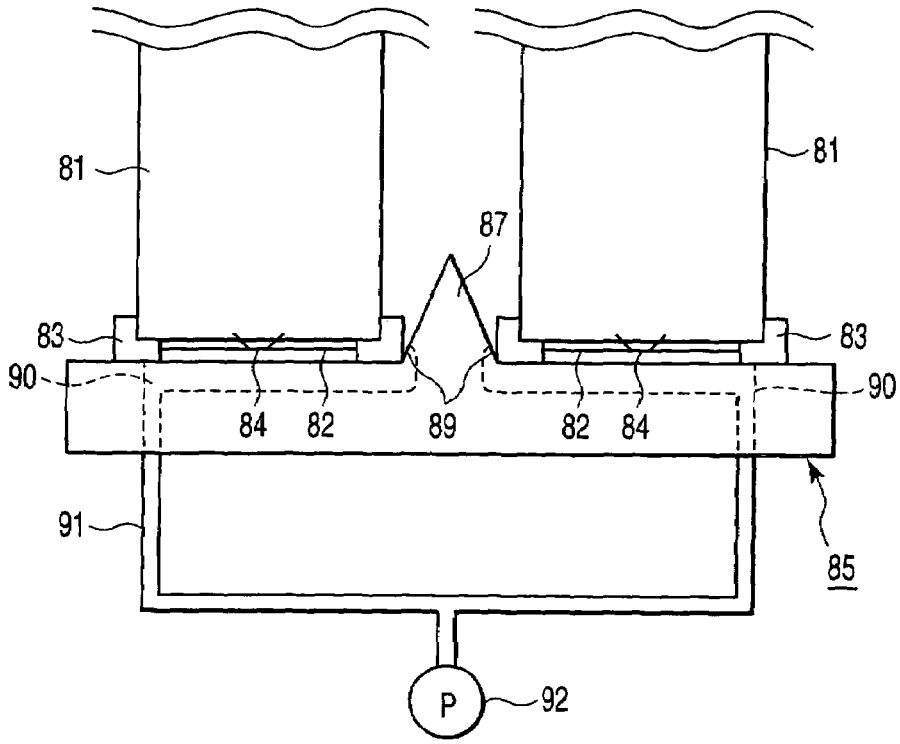
FIG. 19 is a view showing an outline configuration of a negative pressure generation source used in the fifth embodiment.

Moreover, a plurality of suction openings 90 are formed at an end portion of the suction opening portion 88 opposite to the positioning rib 87 side, i.e., at an end portion beyond the nozzles 84 linearly arranged in the recording head 81. These suction openings 90 are coupled with a suction pump 92 which is a negative pressure generation source through a duct 91 attached below the sucking portion 85 as shown in FIG. 19. As a result, air flow is taken into the suction opening portion 88 from the air intake opening 89 by a negative pressure generated by the suction pump 92, and foreign particles or an extra ink on the nozzles 84 or the nozzle plate 82 is discharged to the outside of the sucking portion 85 from the suction openings 90 through the duct 91. It is to be noted that such a flow path of air flow is prepared in accordance with each of the two suction opening portions 88.

Again referring to FIG. 18, each wipe blade 93 is provided on the upper surface 86*a* of the sucking portion main body 86 apart from the suction opening portion 88 by a predetermined distance in the direction indicated by the arrow M in the drawing. Each of these wipe blades 93 is formed of a material having elasticity such as a rubber material, and is brought to touch the nozzle plate 82 to wipe off and remove foreign particles prior to suction and removal of foreign particles or an ink on the nozzle plate 82 at the suction opening portion 88 involved by movement of the sucking portion 85 in the direction indicated by the arrow M in the drawing.

It is to be noted that the thus configured sucking portion 85 is separated from the recording heads 81 and retracted to a position where the sucking portion 85 does not obstruct a non-illustrated paper carriage path or the like when the recording heads 81 are in a standby mode or a printing mode.

A function of the embodiment having such a configuration will now be described.

In this case, prior to an explanation, a pressure in the nozzles 84 of each recording head 81 will be described with reference to FIG. 20. In this case, before a maintenance operation, the inside of each nozzle is maintained in a negative pressure state by the non-illustrated negative pressure source like a "section a" shown in FIG. 20. Then, like a "section b" depicted in FIG. 20, a positive pressure is applied to the inside of each nozzle 84 to push out an ink from the nozzle 84.

Subsequently, when the sucking portion 85 moves along each recording head 81 to suck and remove an extra ink on the nozzle plate 82, a small positive pressure is applied like a "section c" shown in FIG. 20 in order to prevent an ink and air bubbles from flowing back to each nozzle 84. Additionally, the sucking operation by the sucking portion 85 is completed.

Figure 20:
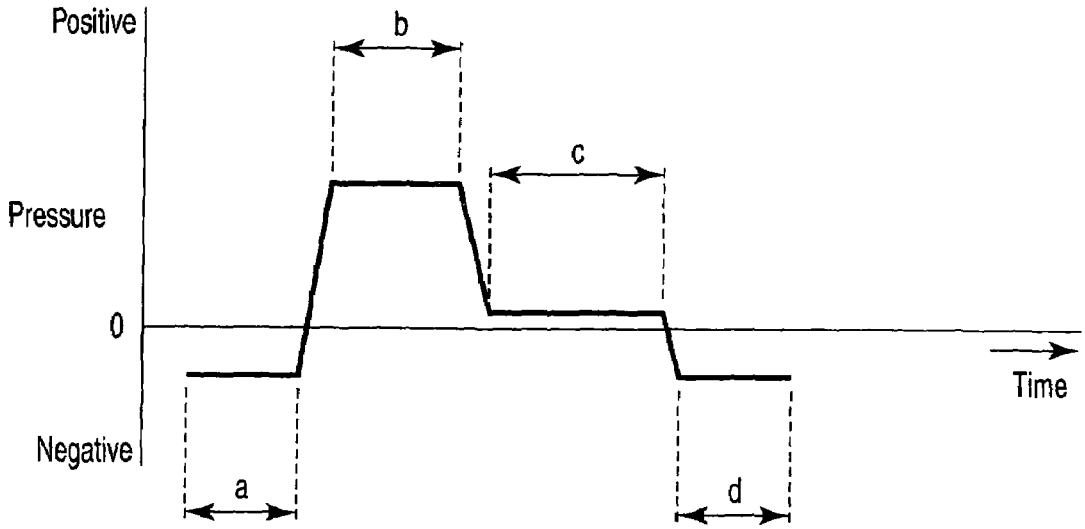
FIG. 20 is a view illustrating a pressure state in a discharge nozzle of an inkjet recording head used in the fifth embodiment.

Thereafter, like a "section d" shown in FIG. 20, the inside of each nozzle returns to the negative pressure state.

FIGS. 21A, 21B to 24 show enlarged cross-sectional views of the recording head 81 and a left half part of the sucking portion 85 depicted in FIG. 19.

Figure 21A:
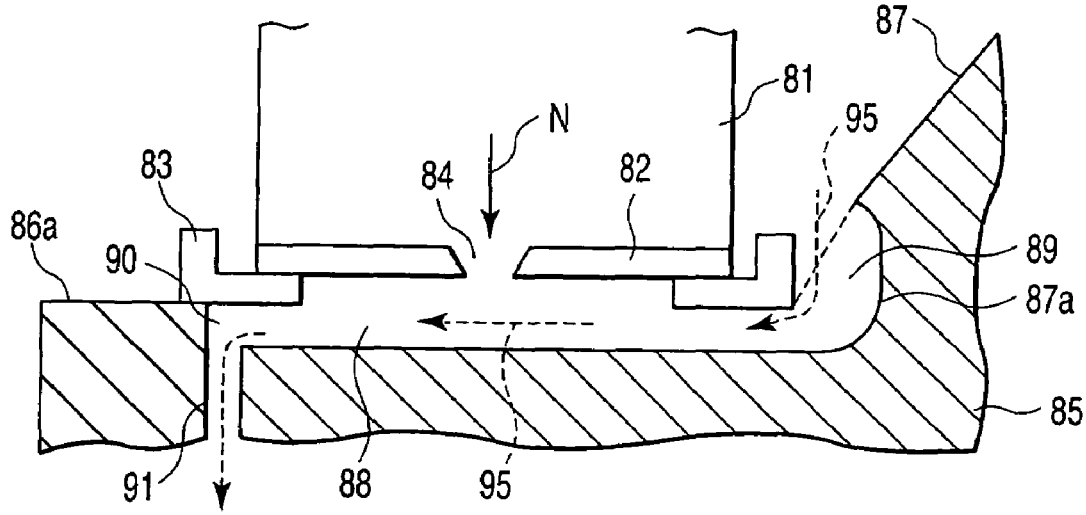
FIG. 21A is an enlarged cross-sectional view showing a primary part of the inkjet recording head and the sucking portion used in the fifth embodiment.

In this case, as shown in FIG. 21A, when the recording head 81 is brought to touch the upper surface 86*a* of the sucking portion main body 86 of the sucking portion 85 and the positioning rib 87, the air intake opening 89 is formed by the notch portion 87*a* at the base end portion of the positioning rib 87, whereby air can be taken in.

In this state, when a negative pressure is generated by the suction pump 92 which is the above-described negative pressure source, as shown in FIG. 21, an air flow (an air current) 95 takes in air from the air intake opening 89, and the taken air is transmitted through the suction opening portion 88 and drawn into the suction pump 92 from the suction opening 90 via the duct 91. At this time, the air flow 95 between the nozzle plate 82 and the sucking portion 85 in the vicinity of the nozzle 84 flows in a direction perpendicular to the nozzle 84 (a direction of ink droplets discharged from the nozzle 84 during printing), i.e., a direction which is substantially orthogonal to a direction indicated by an arrow N in the drawing and also substantially orthogonal to an arrangement direction of the nozzles 84 (which is a direction indicated by the arrow M in FIG. 18 and a direction vertical to the page space in FIG. 21). In this case, it is preferable for the air flow 95 to flow in a direction substantially orthogonal to the direction of ink droplets discharged from the nozzle 84, but the direction of the air flow 95 is not restricted to the orthogonal direction, and any crossing direction can suffice.

Then, when the sucking portion 85 moves along the arrangement direction of the nozzles 84 (the direction indicated by the arrow M in FIG. 17A) with respect to the nozzle plate 82 of the recording head 81, the wipe blade 93 is first brought to touch the nozzle plate 82 to wipe off and remove an ink or foreign particles prior to suction and removal of foreign particles or the ink at the suction opening portion 88.

Figure 22:
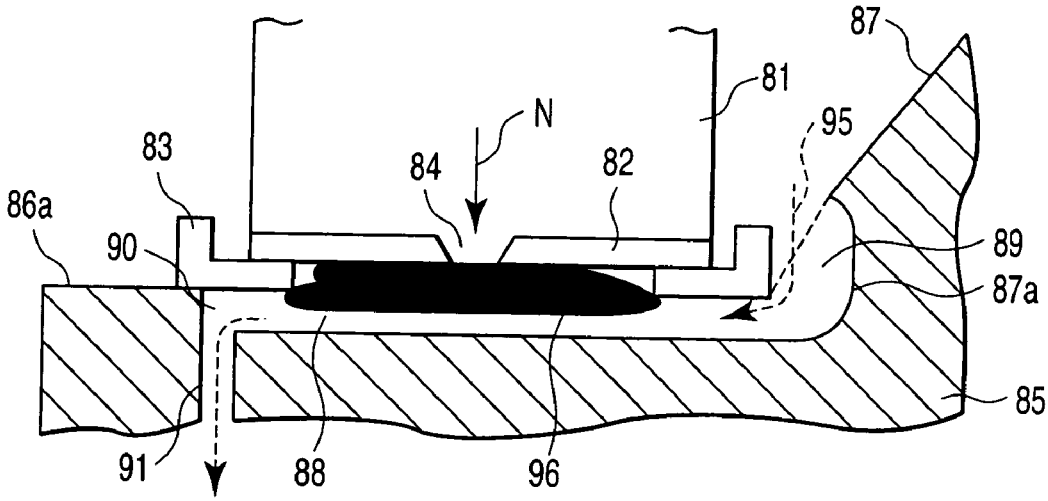
FIG. 22 is an enlarged cross-sectional view showing a primary part of the inkjet recording head and the sucking portion used in the fifth embodiment.

In this case, if a large lump of ink 96 is being pushed out from the nozzle 84 of the recording head 81 by a non-illustrated pressurizing source as shown in FIG. 22, the ink 96 is removed by the wipe blade 93 to some extent and sucked out in a direction of the suction opening 90 by the air flow 95.

Figure 23:
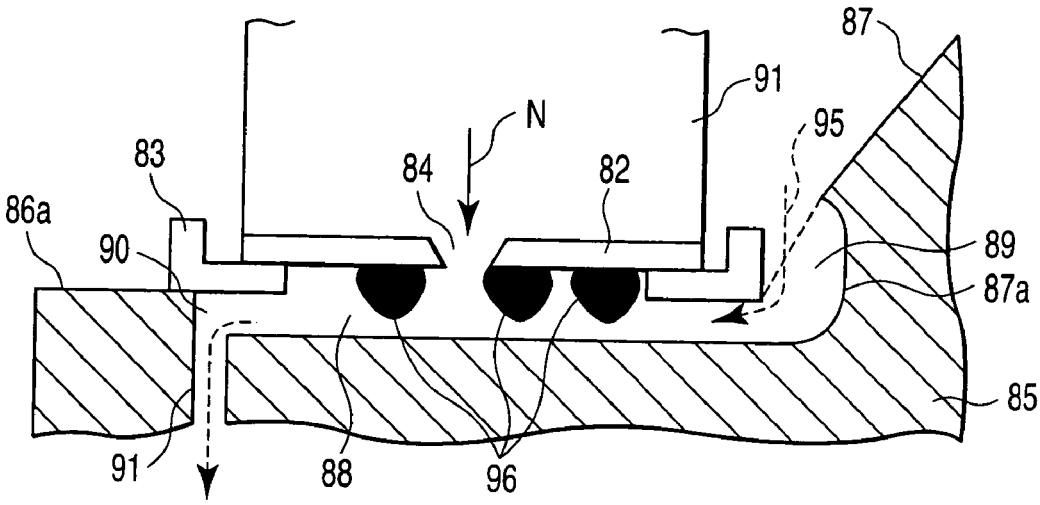
FIG. 23 is an enlarged cross-sectional view showing a primary part of the inkjet recording head and the sucking portion used in the fifth embodiment.

Furthermore, when suction of the ink 96 by the air flow 95 in the sucking portion 85 advances, the above-described ink 96 becomes small lumps of ink 96 on the nozzle plate 92 as shown in FIG. 23, and these lumps remain on the nozzle plate 82 as fine particles of ink 96 as shown in FIG. 24.

In this case, even if the small particles of ink 96 remain in the vicinity of the nozzle 84, the inside of the recording head 81 is maintained in the negative pressure state by the non-illustrated negative pressure source as described in conjunction with FIG. 20 upon completion of the suction operation by the sucking portion 85, whereby small ink droplets are sucked from the nozzle 84.

Meanwhile, the air flow 95 becomes turbulent by a flow path resistance and a pressure fluctuation is generated in the vicinity of the nozzle 84 to prevent smooth suction of foreign particles or the ink in some cases unless a certain width is assured for the suction opening portion 88 of the sucking portion 85.

That is, there is a possibility that the ink breaks into small particles to generate air bubbles in the perpendicular direction (a direction of ink droplets discharged from the nozzles during printing). Therefore, it is preferable for the suction opening portion 88 to have a large width and, in this embodiment, a width of the suction opening 88 is set to 1 mm or above (e.g., 3 mm), a length of the same is set to 4.5 mm and a depth of the same is set to approximately 1 mm when a pitch in the arrangement direction of the nozzles 84 is 169 μm and a moving speed of the sucking portion 85 is 5 mm/s. If the suction opening portion 88 has this dimension, a pressure in the vicinity of each nozzle 84 becomes uniform and stabilized.

A modification of the sucking portion 85 shown in FIG. 21A will now be described.

Figure 21B:
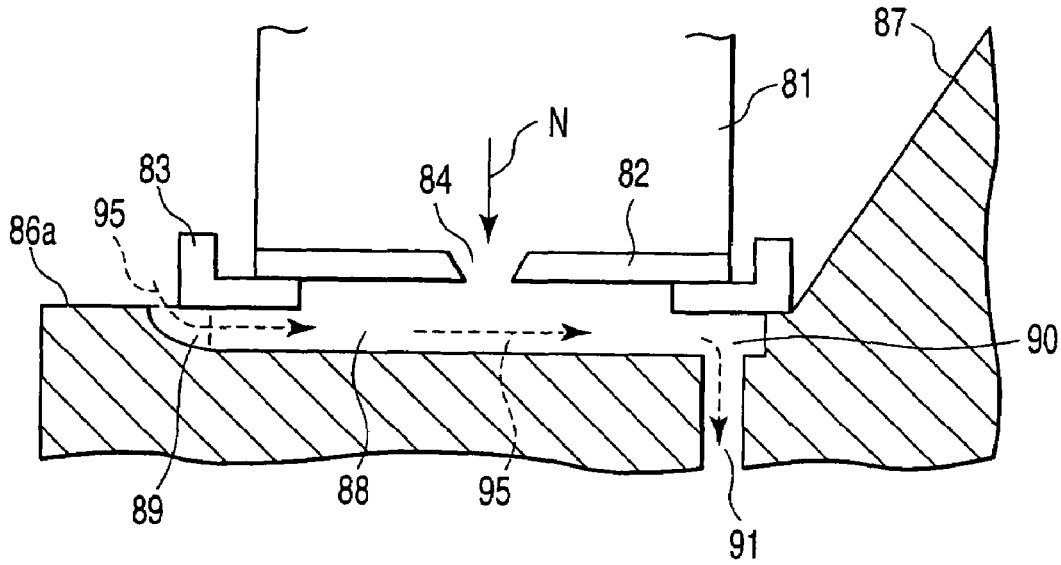
FIG. 21B is a view showing a modification of the sucking portion.

The configuration shown in FIG. 21A is the example in which each air intake opening 89 is formed on the positioning rib 87 side and each suction opening 90 is formed on the outer side. The present invention is not restricted thereto, and it may have a configuration in which the air intake opening 89 is formed on the outer side and each suction opening 90 is formed on the positioning rib 87 side as shown in FIG. 21B. The air flow 95 takes in air from the air intake opening 89 on the outer side, and the taken air is transmitted through the suction opening portion 88 and discharged to the suction pump through the duct 91. Even if such a configuration is adopted, functions and effects equivalent to those of the configuration shown in FIG. 21A can be obtained.

Next, an ink behavior in the vicinity of each nozzle during the sucking operation by the sucking portion 85 will now be described in detail.

A brief description will be first given as to an example where an air flow is generated in a direction perpendicular to the nozzles 84, i.e., a direction of ink droplets discharged from the nozzles 84 during printing for a comparison.

FIGS. 25 and 26 are enlarged cross-sectional views showing the vicinity of the nozzle 84 of the recording head 81. An ink chamber 98 is constituted of a PZT 97 and the nozzle plate 82. Water-shedding coating 82*a* processing is applied to the surface of the nozzle plate 82. First, as shown in FIG. 25, in a state where the ink 96 is pushed out from the nozzle 84 (a state of the "section b" and the "section c" depicted in FIG. 20), and when a direction of the air flow 99 is a direction parallel to the perpendicular direction of the nozzle 84 in the vicinity of the nozzle 84, the ink 96 pushed out from the nozzle 84 is pulled by the air flow 99 along the perpendicular direction of the nozzle 84. Further, as shown in FIG. 26, an end portion of the ink 96 pulled by the air flow 99 breaks into a small piece and is separated as an ink lump 100. When the end portion of the ink 96 breaks into a small piece and is separated as the ink lump 100 in this manner, small air bubbles 101 are generated in this broken part.

However, since the inside of the nozzle 84 is again maintained in the negative pressure state by the non-illustrated negative pressure source (a state of the "section d" shown in FIG. 20) upon completion of the sucking operation by the sucking portion 85, the surrounding air bubbles 101 are drawn into the nozzle 84, which is a factor of inducing non-discharge or discharge deflection of the ink.

On the other hand, in the present invention, an air flow is generated in the perpendicular direction of the nozzle 84, i.e., a direction orthogonal to a direction of ink droplets discharged from the nozzle 84 during printing. This case will now be described with reference to FIGS. 27 to 29.

Figure 27:
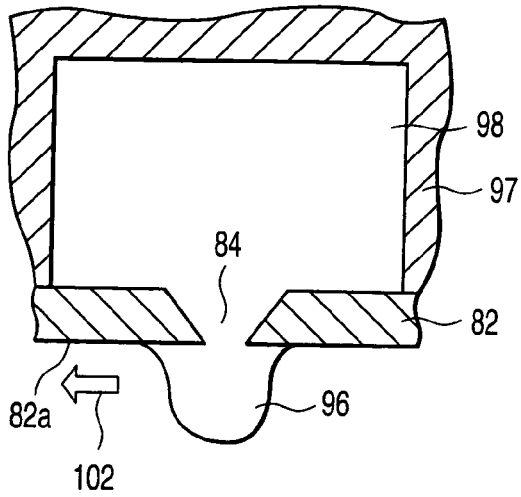
FIG. 27 is an enlarged cross-sectional view showing a primary part in the vicinity of the discharge nozzle of the inkjet recording head used in the fifth embodiment.
Figure 28:
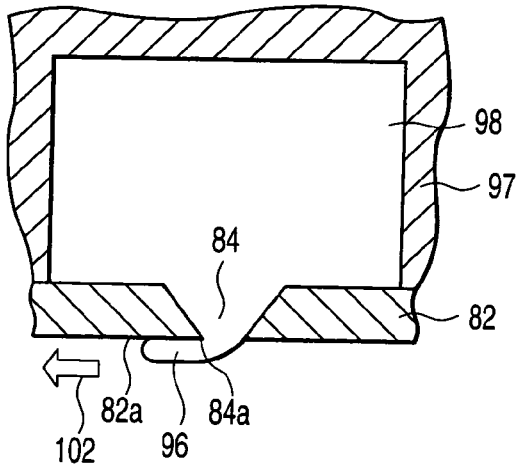
FIG. 28 is an enlarged cross-sectional view showing a primary part in the vicinity of the discharge nozzle of the inkjet recording head used in the fifth embodiment.
Figure 29:
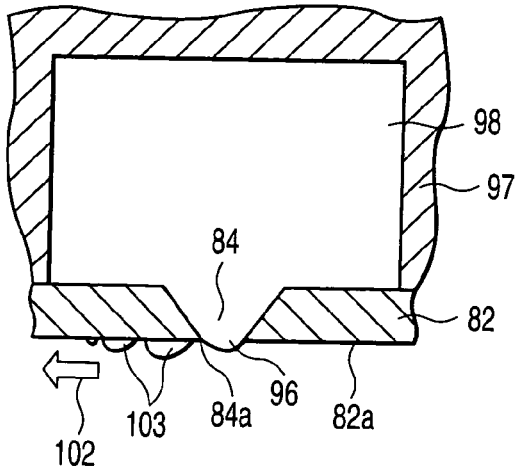
FIG. 29 is an enlarged cross-sectional view showing a primary part in the vicinity of the discharge nozzle of the inkjet recording head used in the fifth embodiment.

First, as shown in FIG. 27, in a state where the ink 96 is pushed out from the nozzle 84 by the non-illustrated pressurizing source (a state of the "section b" and the "section c" shown in FIG. 20), and when a direction of an air flow 102 is a direction orthogonal to the perpendicular direction of the nozzle 84 in the vicinity of the nozzle 84, the ink 96 pushed out from the nozzle 84 is pulled in a parallel direction along the nozzle plate 82 surface by the air flow 102. Further, as shown in FIGS. 28 and 29, the ink 96 pulled by the air flow 102 is transmitted via the water-shedding coating 82*a* on the surface of the nozzle plate 82, separated by an edge portion 84*a* of the nozzle 84 to become an ink lump 103. In this case, since the ink 96 pulled by the air flow 102 is cut and separated by the edge 84*a* of the nozzle 84, small air bubbles are hardly generated. As a result, even if the inside of the nozzle 84 is again maintained in the negative pressure state (a state of the "section d" depicted in FIG. 20) by the non-illustrated negative pressure source upon completion of the sucking operation by the sucking portion 85, air bubbles do not exist in the ink 96 drawn into the nozzle 84, thereby avoiding non-discharge or discharge deflection of the ink which occurs due to absence of air bubbles.

A description will now be given as to a relationship between a pressure in the nozzle 84 (a positive pressure with respect to an atmospheric pressure) and a pressure of the sucking portion 85 (a negative pressure with respect to an atmospheric pressure) when an air flow 99 is generated in parallel with the perpendicular direction of the nozzle 84, i.e., a direction of ink droplets discharged from the nozzle 84 during printing and when an air flow 102 is generated in an orthogonal direction.

As described above, if the air flow 99 is formed in the perpendicular direction of the nozzle 84, the air bubbles 101 are apt to be generated when the ink 95 is sucked out. A pressure in the nozzle 84, i.e., a positive pressure in a period indicated by "section c" depicted in FIG. 20 must be increased during the sucking operation in order to prevent the air bubbles 101 from entering the nozzle 84. However, increasing a pressure in the nozzle 84 pushes out the ink 96 from the nozzle 84 even if the ink 96 is sucked and removed by the sucking portion 96, and the excess ink 96 may possibly remain on the nozzle plate 82. If a suction force of the sucking portion 85 is further increased to suck the ink 96 remaining on this nozzle plate 82, the air bubbles are more apt to be generated when the ink 96 is sucked out. That is, when a process by which the air bubbles are apt to be generated is selected, it is very difficult to balance the pressure in the nozzle 84 and the pressure of the sucking portion 85.

On the other hand, when the air flow 102 is generated in a direction orthogonal to the perpendicular direction of the nozzle 84, the air bubbles are hard to be generated, and hence it is easy to balance the pressure in the nozzle 84 and the pressure of the sucking portion 85. That is, the pressure in the nozzle 84 and the pressure of the sucking portion 85 must be strictly managed and hence a highly accurate pressuring source and suction source are required to increase a cost of the apparatus in the former process, but a rough accuracy is allowed in the latter process, thereby constituting the inexpensive apparatus.

Figure 30:
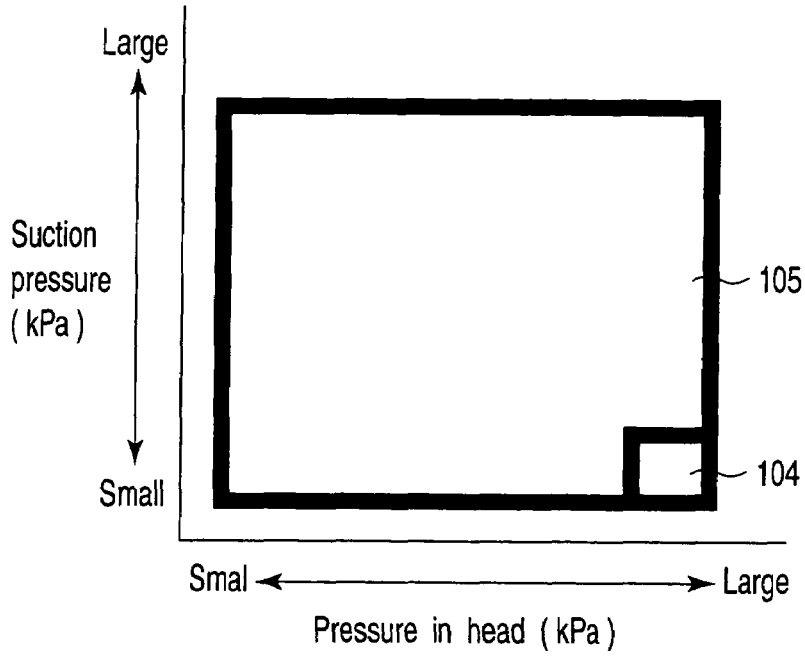
FIG. 30 is a graph showing a relationship between a pressure in the discharge head and a pressure of the sucking portion according to the fifth embodiment obtained from an experiment.

FIG. 30 is a graph obtained from an experiment conducted to grasp a relationship between the pressure in the nozzle 84 and the pressure of the sucking portion 85 in a state where non-discharge or discharge deflection of the ink is not generated when the air flow 99 is generated in parallel with the perpendicular direction of the nozzle 84 and when the air flow 102 is generated in the perpendicular direction, in which a vertical axis represents the pressure of the sucking portion 85 and a horizontal axis represents the pressure in the nozzle 84. In this case, a range surrounded by a small square indicates a region 104 where non-discharge or discharge deflection of the ink is not generated when the air flow 99 is generated in parallel with the perpendicular direction of the nozzle 84, and a range surrounded by a large square indicates a region 105 in which non-discharge or discharge deflection of the ink is not generated when the air flow 102 is generated in the direction orthogonal to the perpendicular direction of the nozzle 84. As apparent from the graph, it can be understood that the region 105 is actually several times the region 104.

Therefore, as described above, the sucking portion 85 is arranged to face each recording head 81 having the nozzle plate 82 on which many nozzles 84 which discharge the ink are linearly arranged, the air flow is formed in the direction which is substantially orthogonal to the direction along which the ink is emitted from the nozzles 84 of the recording head 81 by this sucking portion 85, and foreign particles or excess ink droplets which have adhered to the nozzles 84 are removed by using this air flow, thereby suppressing occurrence of air bubbles in the vicinity of the nozzles 84.

As a result, since maintenance of each recording head 81 can be performed without existence of the air bubbles in the nozzles 84, the high-picture-quality reliable recording head which always does not have non-discharge or discharge deflection of the ink can be recovered as compared with a conventional recording head which cannot discharge the ink or whose discharge direction may be possibly deflected due to collapse of the surface tension of the ink caused by infiltration of the air bubbles.

Furthermore, the suction opening portion 88 of the air intake opening 89 is arranged to sandwich a string of the nozzles 84, and the sucking portion 85 is moved in the arrangement direction of the nozzles 84. Therefore, the air flow generated in the suction opening portion 88 from the air intake opening 89 is constantly fixed in the direction orthogonal to the perpendicular direction of the nozzles 84, thereby effecting stable suction.

Moreover, since the air flow is generated in a direction orthogonal to a direction of emitting the ink from the nozzles 84 to suppress occurrence of air bubbles in the vicinity of the nozzles 84, it is easy to balance a pressure in each nozzle 84 and a pressure of the sucking portion 85. As a result, an accuracy of a pressure applied to the inside of each nozzle 84 or a suction pressure of the sucking portion 85 can be roughly set, thus realizing the inexpensive head maintenance apparatus which can be readily operated.

A sixth embodiment according to the present invention will now be described.

Figure 31:
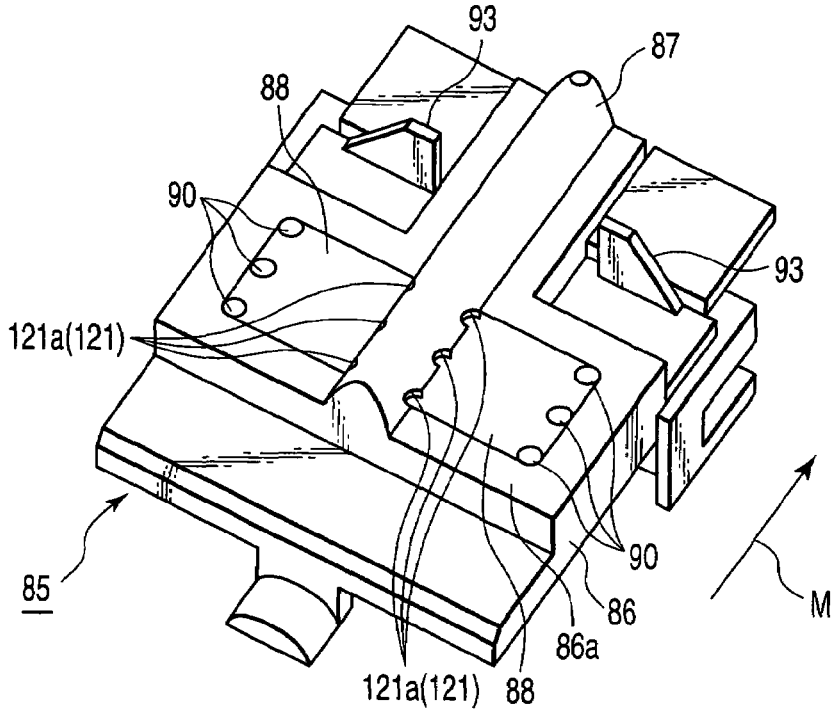
FIG. 31 is a view showing an outline configuration of a sucking portion applied to a sixth embodiment of the present invention.

FIG. 31 shows an outline configuration of a sucking portion 85 applied to a sixth embodiment, and like reference numerals denote parts equal to those in FIG. 18.

In this case, the rectangular opening portion formed of a gap between the notch portion 87*a* of the positioning rib 87 and the recording head 81 is the air intake opening 89 in a state where the upper surface 86*a* of the sucking portion 85 is to touch the recording head 81 in the fifth embodiment, but a plurality of (three in an illustrated example) opening portions 121*a* are formed as an air intake opening 121 at a base end portion of a positioning rib 87 of a suction opening portion 88 along a movement direction (an arrow M in the drawing) of a sucking portion 85 in this sixth embodiment. In this case, each of the plurality of opening portions 121*a* constituting the air intake opening 121 consists of a concave portion having a semicircular cross section which is formed at the base end portion of the positioning rib 87, and the same number of opening portions 121*a* as suction openings 90 are arranged at positions facing the suction openings 90.

Figure 32:
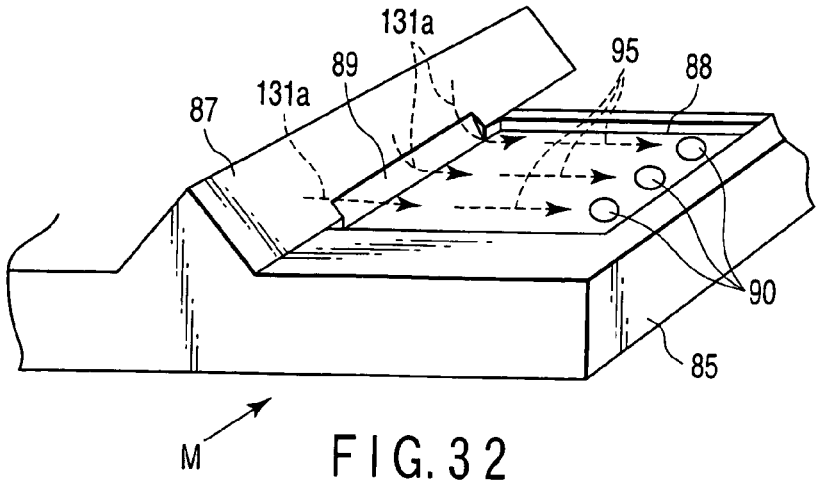
FIG. 32 is a view illustrating a flow of air taken in from an air intake opening used as a comparative example of the sixth embodiment.
Figure 33:
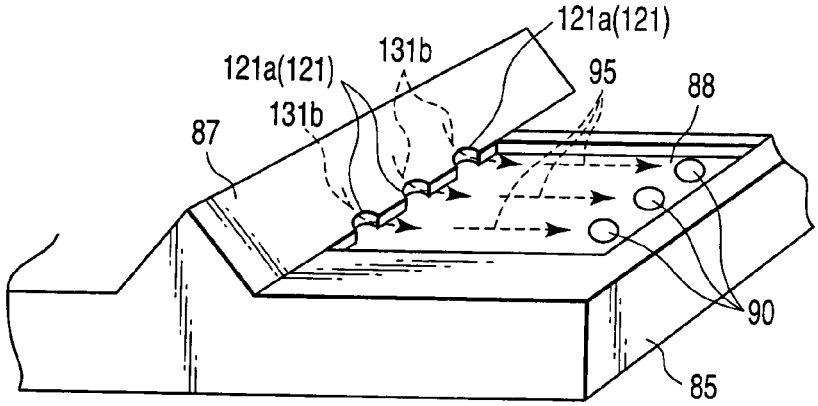
FIG. 33 is a view illustrating a flow of air taken in from an air intake opening used in the sixth embodiment.

As shown in FIG. 32, when the rectangular opening portion is the air intake opening 89 in the fifth embodiment, since this opening is formed of one rectangular opening portion, an air flow 131*a* taken in from the air intake opening 89 is slightly turbulent and drawn into the suction opening portion 88 as indicated by broken lines in the drawing. However, in case of such an air intake opening 121 having the plurality of opening portions 121*a* as shown in FIG. 33, since the plurality of opening portions 121*a* are arranged at positions facing the suction openings 90, each air flow 131*b* taken in from the air intake opening 121 is tidily drawn into the suction opening portion 88 without becoming turbulent.

Therefore, adopting such a configuration can further stabilize the air flow 131*b* in the suction opening portion 88, and foreign particles or an ink on the nozzle plate 82 can be further effectively sucked and removed in the suction opening portion 88. As a result, executing the head maintenance by using such a sucking portion 85 can recover the high-picture-quality reliable inkjet recording head without non-discharge or discharge deflection of the ink.

A seventh embodiment according to the present invention will now be described.

Figure 34:
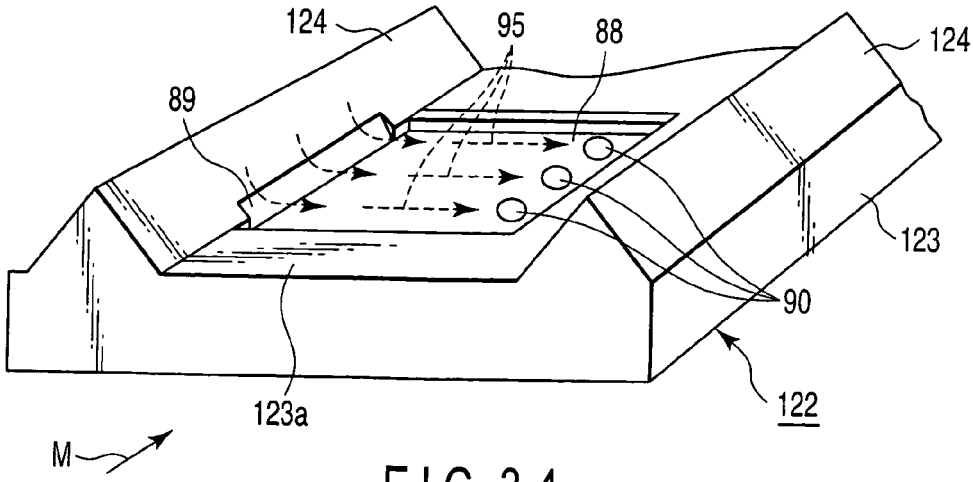
FIG. 34 is a view showing an outline configuration of a primary part of a sucking portion applied to a seventh embodiment of the present invention.

FIG. 34 shows an outline configuration of a primary part of a sucking portion applied to the seventh embodiment, and like reference numerals denote parts equal to those in FIG. 18. In this case, the sucking portion 85 described in conjunction with the fifth embodiment corresponds to the two recording heads 81 arranged in parallel, whereas this seventh embodiment concerns a sucking portion 122 corresponding to one recording head 814.

In the sucking portion 122, two positioning ribs 124 are provided in parallel at both side portions of an upper surface 123*a* of a sucking portion main body 123. These positioning ribs 124 are arranged along a movement direction of the sucking portion 122. Moreover, when a recording head (not shown) is brought to touch and arranged between these positioning ribs 124, foreign particles or an excess ink which has adhered to one recording head can be sucked and removed by an air flow 95 generated in a suction opening portion 88.

Adopting such a configuration can obtain the same effects as those of the fifth embodiment, and executing the head maintenance using such a sucking portion 12 can recover the high-image-quality reliable inkjet recording head which does not have non-discharge or discharge deflection of the ink.

Modifications of the seventh embodiment according to the present invention will now be described.

Figure 35:
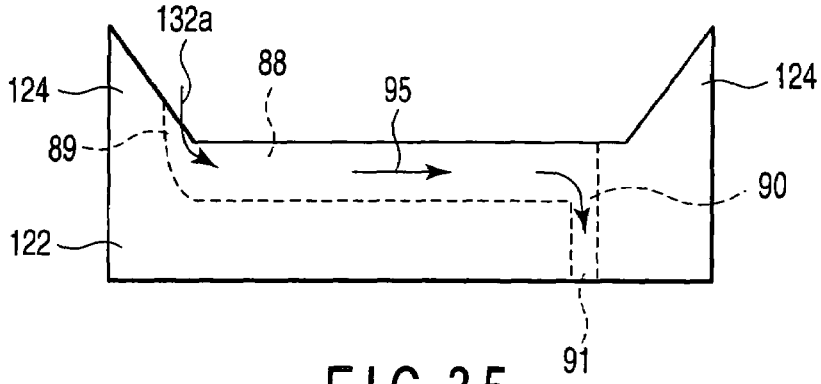
FIG. 35 is a view showing an outline configuration of a primary part in a modification of the seventh embodiment.
Figure 36:
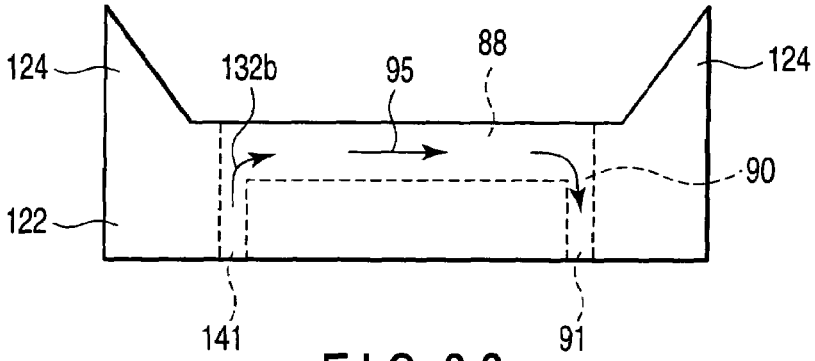
FIG. 36 is a view showing an outline configuration of a primary part in a modification of the seventh embodiment.
Figure 37:
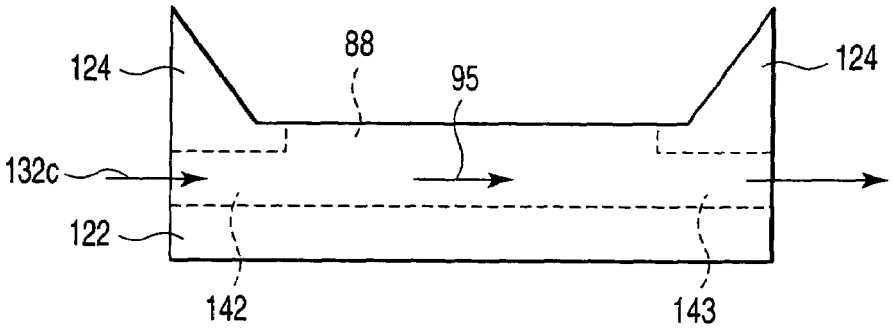
FIG. 37 is a view showing an outline configuration of a primary part in a modification of the seventh embodiment.

FIGS. 35 to 37 show outline configurations of different modifications of the seventh embodiment, and like reference numerals denote parts equal to those in FIG. 18.

FIGS. 35 to 37 are cross-sectional views showing the sucking portion 122 depicted in FIG. 34 from a direction indicated by an arrow M. In this case, in FIG. 35, air 132*a* taken in from an air intake opening 89 is sucked from a suction opening 90 through a suction opening portion 88 and transmitted through a duct 91, thereby generating an air flow 95 orthogonal to a perpendicular direction of each nozzle 84.

On the contrary, in FIG. 36, air 132*b* is taken into a suction opening portion 88 from an air intake opening 141 provided below a sucking portion 122, and this air is sucked from a suction opening 90. This configuration can likewise generate an air flow 95 orthogonal to a perpendicular direction of each nozzle 84.

Additionally, in FIG. 37, air 132*c* is taken into a suction opening portion 88 from an air intake opening 142 provided on a side surface of a sucking portion 122, and sucked from a suction opening 143 provided on a side surface of the sucking portion 122. This configuration can likewise generate an air flow 95 orthogonal to a perpendicular direction of each nozzle 84.

Therefore, executing the head maintenance by using such a sucking portion 122 can recover the high-picture-quality reliable inkjet type recording head without non-discharge or discharge deflection of an ink.

An eighth embodiment according to the present invention will now be described.

FIGS. 38 and 39 show an outline configuration of a primary part of a sucking portion applied to the eighth embodiment, and like reference numerals denote parts equal to those in FIG. 18.

In this case, the sucking portion 85 is relatively moved in the longitudinal direction of the recording head 81 to suck and remove foreign particles or an ink on the nozzle plate 82 in the fifth embodiment, but the sucking portion is not moved in this eighth embodiment.

In FIG. 38, a sucking portion 126 has a length dimension which can cover an entire region of each recording head 81 in a longitudinal direction.

In this case, as shown in FIG. 39, the sucking portion 126 has a sucking portion main body 127 whose length dimension can cover an entire region of each recording head 81 in the longitudinal direction, and a positioning rib 128 is provided at a central part of an upper surface 127*a* of this sucking portion main body 127. When the sucking portion 126 comes to touch the recording heads 81, the positioning rib 128 is positioned between the two inkjet recording heads 81 and positions these inkjet recording heads 81 in a direction orthogonal to an arrangement direction of nozzles.

Two suction opening portions 129 are provided on the upper surface 127*a* of the sucking portion main body 127 with the positioning rib 128 at the center. Each of these suction opening portions 129 also has a dimension corresponding to all the nozzles at the same time. Further, an air intake opening 130 formed between the suction opening portion 129 and the positioning rib 128 is formed of a gap between the positioning rib 128 and the recording head 81 in a state where the sucking portion 126 is to touch each recording head 81, i.e., a state in which the upper surface 126*a* of the sucking portion 126 is to touch each recording head 81. The air intake opening 130 in this example is also formed to have a length corresponding to all the nozzles in each recording head 81. Furthermore, a plurality of suction openings (not shown) are formed at an end portion of the suction opening portion 129 opposite to the positioning rib 128 side in accordance with the air intake opening 130, and air is drawn into the suction opening portion 129 from the air intake portion 130 by a negative pressure generated by a non-illustrated suction pump coupled with these suction openings to discharge foreign particles or an excess ink which has adhered to each recording head 81 to the outside.

Adopting such a configuration can suck and remove foreign particles or an excess ink on the recording head 81 side without moving the sucking portion 126, and hence driving means for moving the sucking portion 126 in the longitudinal direction of each recording head 81 is no longer necessary, thereby realizing a reduction in size of the apparatus at a low cost.

It is to be noted that the present invention is not restricted to the foregoing embodiments, and it can be modified in many ways without departing from the scope of the invention on embodying stages.

Furthermore, the foregoing embodiments include inventions on various stages, and various inventions can be extracted by appropriately combining a plurality of disclosed structural requirements. For example, even if some of all structural requirements disclosed in the embodiments are eliminated, the problems described in the section "problems to be solved by the invention" can be solved, and a configuration in which these structural requirements are eliminated can be extracted as an invention when the effects described in the section "effects of the invention" can be obtained.

According to the present invention, it is possible to provide the head maintenance apparatus which can assuredly remove foreign particles or ink droplets which have adhered to a part close to the nozzles in the inkjet recording head.

According to the present invention, it is possible to provide the recording head maintenance apparatus which can avoid a damage to the nozzles or the nozzle surface when removing a residual ink or dust from the nozzle surface of the recording head and realize the maintenance processing on the entire nozzle surface.

According to the recording head maintenance apparatus of the present invention, attachments (foreign particles such as dust or a residual ink) which are sucked and moved from one nozzle and its periphery by an air flow (or an air current) flowing in a direction crossing the nozzle string cross at most one nozzle alone, so that the attachments do not pass through the other nozzles or the nozzle surface, thus avoiding occurrence of new clogging or a damage to the nozzle surface.

Moreover, since the air flow flows from an end to the other end of the suction groove in this manner, the residual ink or foreign particles can be sucked and removed on surfaces on both sides of the nozzle string.

It is to be noted that the present invention is not restricted to the foregoing embodiments, and the present invention can be modified in many ways without departing from the scope of the invention on embodying stages.

Additionally, the foregoing embodiments include inventions on various stages, and various inventions can be extracted by appropriately combining a plurality of disclosed structural requirements.

For example, even if some of all structural requirements disclosed in the embodiments are eliminated, the problems described in the section "problems to be solved by the invention" can be solved, and a configuration in which these structural requirements are eliminated can be extracted as an invention when the effects described in the section "effects of the invention" can be obtained.

What is claimed is:

1. A maintenance apparatus of a recording head, which is applied to an inkjet recording head including a nozzle plate on which a plurality of nozzles for discharging ink are linearly arranged, the maintenance apparatus comprising:

a sucking portion which faces the nozzle plate and which exerts a suction force with respect to at least one of the nozzles and the nozzle plate, wherein the sucking portion includes:

a suction groove on a surface of the sucking portion facing the nozzle plate, a suction opening at a first end portion of the suction groove, and an air intake opening at a second end portion of the suction groove such that the linearly arranged nozzles are sandwiched by the suction opening and the air intake opening; and wherein an air current flows in a direction substantially orthogonal to a discharge direction of the ink discharged from the nozzles.

2. The maintenance apparatus of a recording head according to claim 1, wherein a width of the suction groove in the sucking portion in an arrangement direction of the nozzles is set to more than 1 mm.

3. The maintenance apparatus of a recording head according to claim 2, wherein the sucking portion includes a plurality of suction grooves which are arranged in the arrangement direction of the nozzles.

4. The maintenance apparatus of a recording head according to claim 3, wherein the suction opening comprises a plurality of holes.

5. The maintenance apparatus of a recording head according to claim 1, wherein the sucking portion is configured to relatively move along the linearly arranged nozzles, and the suction opening and the air intake opening are formed on the sucking portion such that a line connecting the suction opening and the air intake opening matches a direction that is substantially orthogonal to a relative movement direction of the sucking portion.

6. The maintenance apparatus of a recording head according to claim 1, wherein the sucking portion is configured to relatively move along the linearly arranged nozzles, and the suction groove extends along a direction substantially orthogonal to a relative movement direction of the sucking portion.

7. The maintenance apparatus of a recording head according to claim 6, wherein a length of the suction groove is such that the air current produced in the suction groove is generated beyond a width of the nozzle plate.

8. The maintenance apparatus of a recording head according to claim 1, wherein the sucking portion contacts with the inkjet recording head to form the air intake opening.

9. The maintenance apparatus of a recording head according to claim 1, wherein the sucking portion includes a positioning portion which positions the sucking portion with respect to the recording head.

10. The maintenance apparatus of a recording head according to claim 9, wherein the sucking portion includes a spring which pushes the sucking portion with respect to the recording head.

11. The maintenance apparatus of a recording head according to claim 10, wherein a contact part in the sucking portion with respect to the recording head is formed of a material whose hardness is lower than that of a contact part on the recording head side.

12. The maintenance apparatus of a recording head according to claim 10, wherein the sucking portion includes a swiveling shaft and a bearing which allow oscillation of the sucking portion around an axis corresponding to a movement direction of the sucking portion.

13. The maintenance apparatus of a recording head according to claim 1, wherein the suction groove has a length exceeding a width of the nozzle plate, in a direction orthogonal to a nozzle arrangement direction.

14. The maintenance apparatus of a recording head according to claim 1, wherein a corner portion in the suction groove is rounded.

15. A maintenance apparatus of a recording head comprising:

a recording head which comprises a plurality of linearly arranged nozzles and a nozzle plate on which the nozzles are formed;

a sucking portion which covers some of the plurality of nozzles of the recording head and which generates an air current that sucks an ink; and a scanning mechanism which moves the sucking portion along an arrangement direction of the nozzles;

wherein, the sucking portion includes:

a suction groove which faces the nozzles, in a direction orthogonal to an ink discharge direction and along a direction crossing the nozzle arrangement direction;

an air intake portion which is provided on a first end of the suction groove; and sucking openings which are provided on a second end of the suction groove, at a position different from a position that faces the nozzles, and wherein the air current is generated in the suction groove.

16. The maintenance apparatus of a recording head according to claim 15, wherein a width of the suction groove in the arrangement direction of the nozzles is set at not less than 1 mm.

17. The maintenance apparatus of a recording head according to claim 15, wherein the sucking portion includes a plurality of suction grooves.

18. The maintenance apparatus of a recording head according to claim 15, wherein the sucking portion contacts with the recording head to form the air intake portion.

19. The maintenance apparatus of a recording head according to claim 18, wherein the plurality of sucking openings are arranged in the arrangement direction of the nozzles.

20. The maintenance apparatus of a recording head according to claim 15, wherein the sucking portion includes a positioning portion which positions the sucking portion with respect to the recording head.

21. The maintenance apparatus of a recording head according to claim 20, wherein the sucking portion includes a spring which pushes the sucking portion with respect to the recording head.

22. The maintenance apparatus of a recording head according to claim 21, wherein a contact part in the sucking portion with respect to the recording head is formed of a material whose hardness is lower than that of a contact part on the recording head side.

23. The maintenance apparatus of a recording head according to claim 21, wherein the sucking portion includes a swiveling shaft and a bearing which allow oscillation of the sucking portion around an axis corresponding to a movement direction of the sucking portion.

24. The maintenance apparatus of a recording head according to claim 15, wherein the suction groove has a length exceeding a width of the nozzle plate, in a direction orthogonal to the nozzle arrangement direction.

25. The maintenance apparatus of a recording head according to claim 15, wherein the suction groove has a length such that the air current produced in the suction groove is generated beyond a width of the nozzle plate.

26. The maintenance apparatus of a recording head according to claim 15, wherein a corner portion in the suction groove is rounded.

* * * * *